US005951145A

United States Patent [19]

Iwasaki et al.

[11] Patent Number: 5,951,145

[45] Date of Patent: Sep. 14, 1999

[54] LIGHTING APPARATUS

[75] Inventors: Fumitsugu Iwasaki; Ryouichi Komai, both of Yokohama; Keiji Takahashi; Kouji Takahashi, both of Yokosuka; Keiichi Shimizu, Yokohama; Junya Hayashi, Yokosuka, all of Japan

[73] Assignee: Toshiba Lighting & Technology Corporation, Tokyo, Japan

[21] Appl. No.: 08/821,300

[22] Filed: Mar. 20, 1997

[30] Foreign Application Priority Data

| | | | |
|---|---|---|---|
| Mar. 22, 1996 | [JP] | Japan | P.8-066854 |
| Jun. 5, 1996 | [JP] | Japan | P.8-143292 |
| Jul. 5, 1996 | [JP] | Japan | P.8-176913 |
| Aug. 20, 1996 | [JP] | Japan | P.8-218945 |

[51] Int. Cl.[6] ..... F21S 5/00

[52] U.S. Cl. ..... 362/216; 362/222; 362/225; 362/226; 362/247; 362/304; 362/408

[58] Field of Search ..... 316/147, 216, 316/221, 222, 225, 226, 276, 304, 305, 404, 408, 440, 802; 439/227–229, 236; 362/241, 247

[56] References Cited

U.S. PATENT DOCUMENTS

| | | | |
|---|---|---|---|
| 1,437,448 | 12/1922 | Ruttle | 362/440 |
| 1,995,700 | 3/1935 | Butler | 362/408 |
| 2,309,676 | 2/1943 | Schmidling | 362/216 |
| 2,406,896 | 9/1946 | Owen | 362/216 |
| 2,589,760 | 3/1952 | Zelt | 362/216 |
| 4,225,905 | 9/1980 | Moriyama et al. | 362/216 |
| 4,410,930 | 10/1983 | Yachabach | 362/276 |
| 5,105,118 | 4/1992 | Shinada et al. | 362/216 |
| 5,282,118 | 1/1994 | Lee | 362/276 |

FOREIGN PATENT DOCUMENTS

| | | | |
|---|---|---|---|
| 1141825 | 3/1957 | France | 362/216 |
| 402257509 | 10/1990 | Japan | 362/408 |

*Primary Examiner*—Alan Cariaso
*Attorney, Agent, or Firm*—Oblon, Spivak, McClelland, Maier & Neustadt, P.C.

[57] ABSTRACT

A lighting apparatus comprises a circular fluorescent lamp having inner and outer circular portions arranged coaxially and having outer diameters different each other, the inner circular portion having an outer meter of 285 mm to 310 mm and comprising a first arc tube having a tube diameter of 15 mm to 21 mm and the outer circular portion having an outer diameter of 360 to 390 mm comprising a second arc tube having a tube diameter of 15 to 21 mm. The lighting apparatus further comprises an apparatus body to which the circular fluorescent lamp is assembled. The apparatus body is provided with light reflection member adapted to reflect a light from the fluorescent lamp means.

11 Claims, 24 Drawing Sheets

LIGHTING APPARATUS

BACKGROUND OF THE INVENTION

The present invention relates to a lighting apparatus to which a ring-like, i.e. circular, fluorescent lamp is fitted and which has a disc-shaped apparatus body.

In a prior art, there has been known a lighting apparatus, such as disclosed in Japanese Patent Laid-open Publication No. HEI 8-45334, having a structure in which a holder fitting portion is formed in a disc-shaped apparatus body having a reflection surface on its lower surface, and a holder member for coaxially fitting a plurality of circular fluorescent lamps is mounted to the holder fitting portion.

On the other hand, in recent years, a fluorescent lamp having an emission arc tube with a small tube diameter has come into widespread use for the reduction of the thickness and the decreasing in the size thereof.

However, in the case of directly mounting a circular fluorescent lamp in a prior structure such as of the above prior art publication, since the thin circular fluorescent lamp has a large bright light output per unit area, there is a somewhat undesirable problem on lamp image and others.

SUMMARY OF THE INVENTION

An object of the present invention is to substantially eliminate defects and drawbacks encountered in the prior art and to provide a lighting apparatus having a compact structure, being capable of preventing an excessive light image from appearing and improving lighting performance of a fluorescent lamp of the apparatus.

This and other objects can be achieved according to the present invention in a general aspect by providing a light apparatus comprising:

a circular fluorescent lamp means having inner and outer circular portions arranged coaxially and having outer diameters different from each other, the inner circular portion having an outer diameter of 285 mm to 310 mm and comprising a first arc tube having a tube diameter of 15 mm to 21 mm and the outer circular portion having an outer diameter of 360 to 390 mm and comprising a second arc tube having a tube diameter of 15 to 21 mm; and an apparatus body to which the circular fluorescent lamp means is assembled, the apparatus body being provided with light reflection means adapted to reflect a light from the fluorescent lamp means.

In preferred embodiments of the lighting apparatus mentioned above, the lighting apparatus further comprises a holder member for holding the fluorescent lamp means and the apparatus body is formed with a holder member fitting means for detachably mounting the holder member, the light reflection means including a first light reflection portion to which the holder member fitting means is formed to reflect a light from the second arc tube in a circumferential direction of the apparatus body.

The apparatus body is formed with a holder member fitting means for detachably mounting the holder member, the light reflection means including a first light reflection portion to which the holder member fitting means is formed to reflect a light from the second arc tube in a circumferential direction of the apparatus body, and the light reflection means includes a second light reflection portion disposed at substantially a central portion of the circular fluorescent lamp means to reflect a light therefrom. The second light reflection portion has a protruded shape having substantially a triangle shape in elevational section thereof.

The apparatus body has a suspension type structure.

The first and second arc tubes are independent circular arc tubes disposed coaxially or composed of a circular arc tube unit having coaxially disposed two circular portions which are electrically connected. The first and second circular arc tubes may be arranged substantially in a same horizontal plane concentrically.

The holder member comprises a lamp socket disposed on one end side thereof for electrically connecting the circular fluorescent lamp means and holding the same, a lamp holder portion for holding the circular fluorescent lamp means disposed on another end side thereof, and an interlocking member for holding the lamp socket and the lamp holder portion at an equal distance from a central position thereof. The lamp socket has a structure applicable to a general type fluorescent lamp including an arc tube having a tube diameter of approximately 29 mm.

The holder member includes a lamp holder portion for holding the fluorescent lamp means and the lamp holder portion is formed with a cord pressing member for preventing a cord, through which an electricity is supplied to the fluorescent lamp means, from projecting from the apparatus body.

A shade is attached to the apparatus body.

The lighting apparatus further comprises a lighting unit applicable to light a general type fluorescent lamp having an arc tube having a tube diameter of approximately 29 mm as well as an arc tube having a tube diameter of 15 mm to 21 mm.

A night light may be further provided for the apparatus body.

The apparatus body is provided with a substrate member to which is mounted a lighting control circuit means which is controlled by a remote control means provided for the apparatus body.

A person sensor is further mounted to the apparatus body and a sensor for sensing a brightness of an ambient portion is provided for the apparatus body.

In a further broader aspect of the present invention, there is provided a lighting apparatus comprising:

a circular fluorescent lamp means having inner and outer circular portions arranged coaxially and having outer diameters different from each other; and an apparatus body to which the circular fluorescent lamp means is assembled, the apparatus body being provided with light reflection means adapted to reflect a light from the fluorescent lamp means.

In this aspect, as mentioned before, the inner circular portion may have a an outer diameter of 285 mm to 310 mm and comprising a first arc tube having a tube diameter of 15 mm to 21 mm and the outer circular portion has an outer diameter of 360 to 390 mm and comprising a second arc tube having a tube diameter of 15 to 21 mm.

In this and former aspects, the holder member includes a lamp holder portion having one end to which an insertion portion is formed and another end portion to which a lock portion is formed and the lamp holder fitting means is formed with an insertion hole to which the insertion member is inserted and an engaging portion to be engaged with the lock portion.

The apparatus body is provided with a string pulling arm member to be rotatable and retractable, the string pulling arm member having a string insertion hole at a tip end thereof.

The apparatus body is provided with a light controlling means such as shade, a receiving member attached to the light controlling means for receiving the same and a supporting member having a spring for pressing the receiving member upwardly so as to support the receiving member to be detachable by rotating the same.

The apparatus body has a disc-shaped structure and is provided with a circuit substrate in form of sector to be substantially concentrically therewith and with an operation means arranged to a portion of the disc-shaped apparatus body other than the portion to which the circuit substrate is formed.

The lighting apparatus is a suspension type suspended from a ceiling, such as of a room, in which the apparatus body is suspended from the ceiling through a hook ceiling to which an adaptor is mounted and the apparatus body is provided with an opening to which the adaptor is engaged and a heat radiation hole formed to a portion facing a side surface of the adaptor and the apparatus body being further provided with a circuit substrate for controlling the lighting of the fluorescent lamp means.

The apparatus body has a disc-shaped structure and is provided with a circuit substrate in form of sector to be substantially concentrically therewith and further comprising an electric part hard to be heated arranged to the circuit substrate in form of projection to a portion near an end portion of the sector and a heat generating part arranged to an end side of the electric part and a portion opposite to the end side thereof.

According to the present invention of the structures and characters described above, in the general aspect thereof, the circular fluorescent lamp having a tube diameter of 15 mm to 21 mm and having a relatively low strength is set in the holder member, and at the time of the replacement of the circular fluorescent lamp, the holder member is detached without applying an unnecessary force to the lamp. Accordingly, the circular fluorescent lamp can be protected even if the lighting apparatus is formed so as to provide a relatively thin configuration. In addition, although, in such circular fluorescent lamp, the light output per unit area increases, the light from the circular fluorescent lamp is reflected by the outer circumferential reflection surface portion, so that the light from the circular fluorescent lamp is dispersed to eliminate the occurrence of the excessive lamp image, thereby improving the uniformity of ratio of illuminance. Moreover, in the case of having the arc tube diameter below 15 mm, low strength of the emission of light is felt by a person, and hence, considerable care have to be taken to the handling and it will not be put into a practical use. On the other hand, in the case of having the arc tube diameter above 18 mm, difficulty is encountered to design the reflection surface for light control. Furthermore, in the case of the emission arc tubes having an outer diameter of 285 mm to 310 mm and an outer diameter of 360 mm to 390 mm, they are substantially equal in tube diameter to the current fluorescent lamps, and therefore, not only the sense of incongruity due to the small tube diameter can be softened, but also the emission length becomes long and the emission area enlarges to provide light distribution with extension.

In addition, even if using a circular fluorescent lamp having a large light output per unit area, the light from the circular fluorescent lamp is reflected by the central reflection surface portion of the apparatus body, so that the brightness of the central portion of the apparatus body does not decrease and the light from the circular fluorescent lamp is dispersed to make difficult the occurrence of lamp image to enhance the uniformity of ratio of illuminance.

Furthermore, the circular fluorescent lamp is set in the holder member, and at the time of the replacement of the circular fluorescent lamp, the holder member is detached without substantially applying an unnecessary force to the lamp, and the circular fluorescent lamp can be hence protected. Since the cord pressing section for pressing the projection of a cord is provided in the holder member, it is possible to inhibit the projection of the cord to prevent the cord from shutting out the light from the circular fluorescent lamp.

Since the shade is attached to the apparatus body, the lamp image is hard to occur, and the uniformity of ratio of illuminance can be improved.

Since the interlocking mechanism is provided to place the lamp holder and the lamp socket at an equal distance from the central position thereof, even if the tube diameter of the circular fluorescent lamp involves errors to change the distance between the lamp socket and the lamp holder, it is possible to align the central position of the circular arc tubes with the central position of the apparatus body. Accordingly, even if the ring configurations of the circular tubes are different from each other, it is possible to maintain substantially the same illuminating condition.

Since the lamp socket is common to a socket connected to a general type fluorescent lamp having an emission arc tube having the tube diameter of approximately 29 mm, if selecting any socket, it is possible to use both the general type fluorescent lamp with an emission tube having a tube diameter of 29 mm and the fluorescent lamp of the present invention having the tube diameter of 15 mm to 21 mm. The lighting unit for lighting a general type fluorescent lamp having an emission tube of a tube diameter of approximately 29 mm is usable, and hence, if selecting any lighting unit, it is possible to use both the general type fluorescent lamp with an emission tube having a tube diameter of 29 mm and the fluorescent lamp of the present invention having a tube diameter of 15 mm to 21 mm. The lighting unit and the socket are arranged to be common to lighting units and sockets for a general type fluorescent lamp with an emission tube having a tube diameter of approximately 29 mm. When these socket and lighting unit are mounted, the general type fluorescent lamp is lightened. If selecting any socket and lighting unit, it is possible to apply them to both the general type fluorescent lamp with an emission tube having a tube diameter of 29 mm and the fluorescent lamp of the present invention having a tube diameter of 15 mm to 21 mm.

The remote control unit may be attached to a central portion of the apparatus body without destroying the weight balance.

The lighting or putting-out of the lamp is possible in accordance with the presence or absence of a person as well as the brightness, and it is possible to surely light the lamp when needed and to certainly put out the lamp when unnecessary.

After the insertion portion of the holder member is inserted into the insertion hole of the apparatus body, the locking member of the holder member is engaged with the locking portion of the apparatus body, so that the holder member can easily be fitted in the apparatus body by one hand.

Since the string pulling device is disposed to be rotatable with respect to the apparatus body, it can be housed within the apparatus body without expanding the advancing and retreating distance thereof. Further, since the string pulling device can advance and retreat, the protruding distance of the string pulling arm device with respect to the apparatus body can be arbitrarily set.

Since the receiving member can be inserted and detached into and from the supporting member by rotating with respect to the supporting member body and the light controlling means is pressed against the apparatus body side at the attachment of the receiving member, it is possible to employ a simple construction to prevent the light controlling means from falling out from the apparatus body and further to reduce the separation between the light controlling means and the apparatus body.

Since the parts within the apparatus body are disposed with efficiency taking into consideration the weight balance, the size of the apparatus body can be reduced.

Since the heat from the circuit substrate arranged to the apparatus body can be released through the radiation hole formed to the holder fitting portion in an opposed relation to the adaptor, and if there is a gap between the holder fitting portion and the adaptor, further radiation occurs from this gap. Thus, it is possible to surely suppress the heat of the circuit substrate and to prevent the temperature from rising unnecessarily.

Although the hard-to-heat component is formed in a projecting manner, it is possible to eliminate the adverse influence of, for example, the synergistic heat from the heating parts.

Incidentally, the lighting apparatus is, in every case, applicable to a directly ceiling-attached type, a ceiling light type, a pendant type and other arbitrary configurations.

Furthermore, the first emission arc tube having a tube diameter of 15 mm to 21 mm and an outer diameter of 285 mm to 310 mm, the second emission arc tube having a tube diameter of 15 mm to 21 mm and an outer diameter of 360 mm to 390 mm, and the upper and lower limits of the tube diameter of approximately 29 mm can vary within the range of ±10%.

The nature and further characteristic features of the present invention will be made more clear from the following descriptions with reference to the accompanying drawings.

DESCRIPTION OF THE PREFERRED EMBODIMENTS

Figure 1:
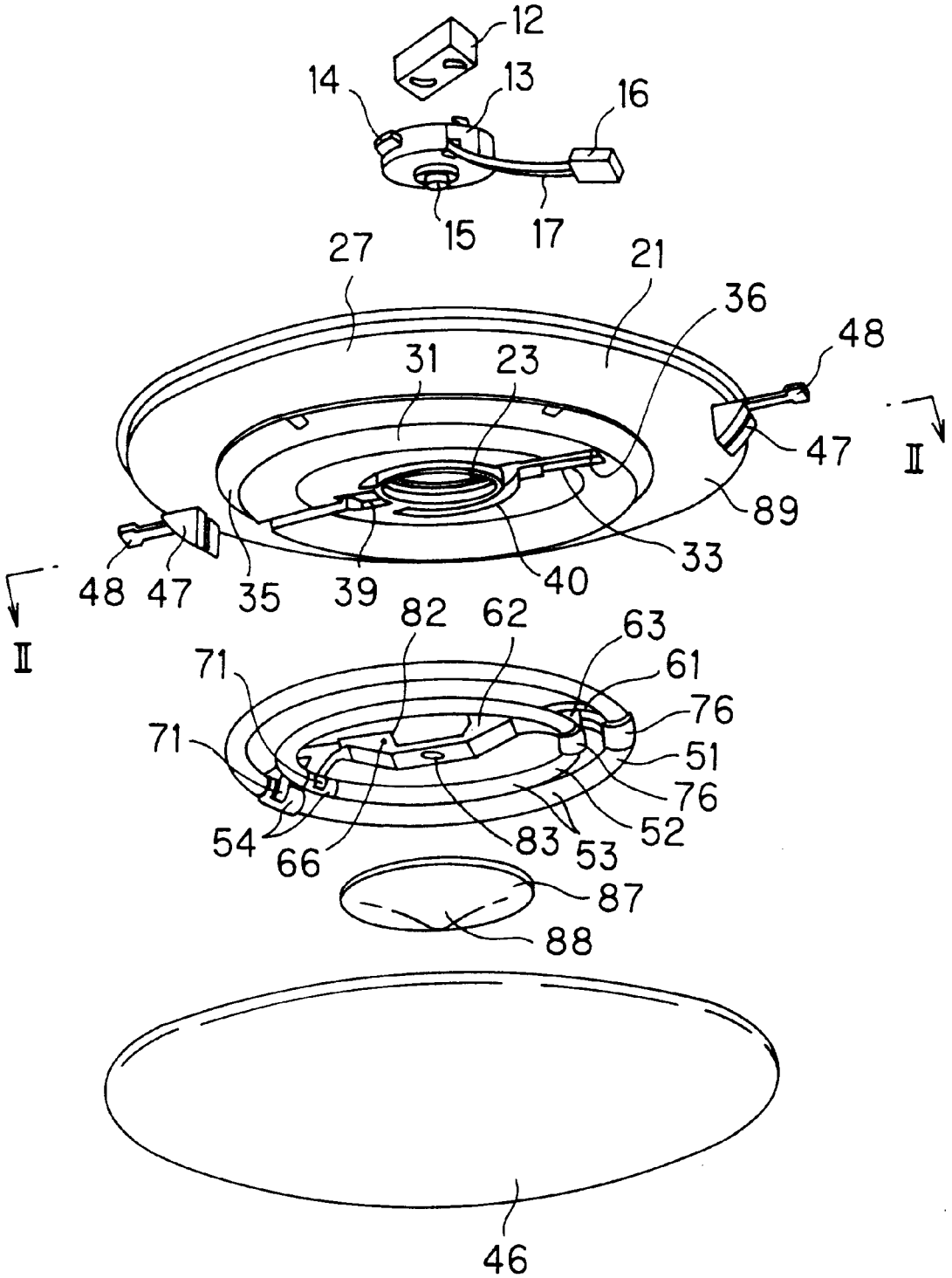
FIG. 1 is an exploded perspective view showing a lighting apparatus of discharge type according to a first embodiment of the present invention.
Figure 2:
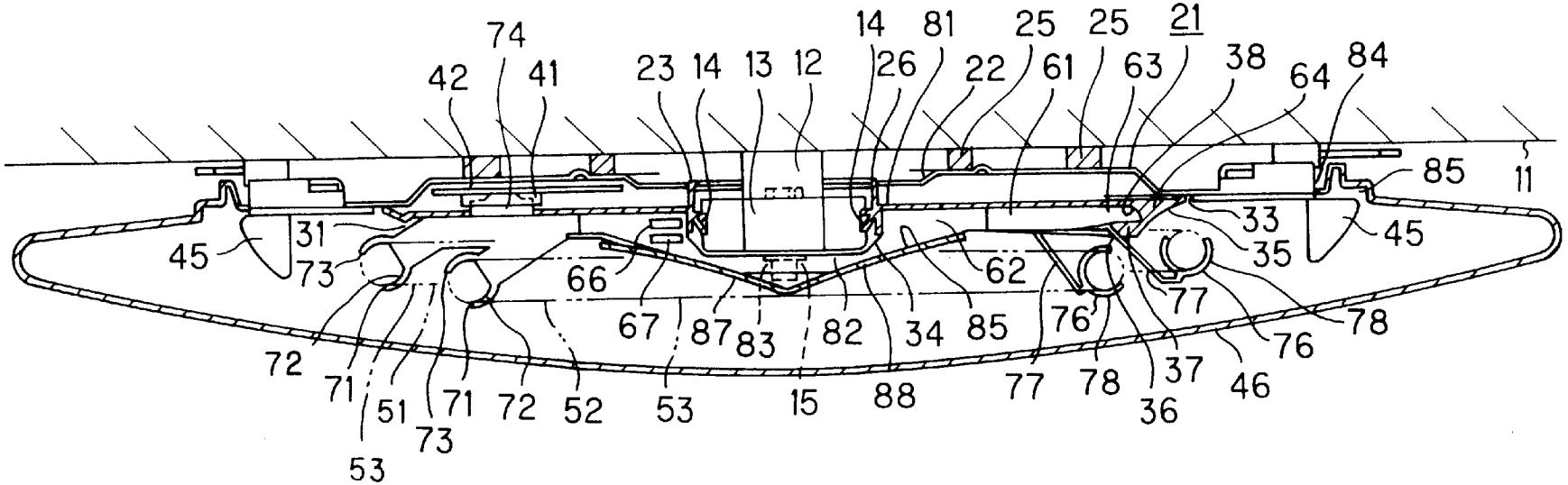
FIG. 2 is a cross-sectional view showing the lighting apparatus taken along the line II—II of FIG. 1.

The present invention will be described hereunder by way of preferred embodiments shown in the accompanying drawings.

A first embodiment of the lighting apparatus of the present invention will be described hereunder with reference to FIGS. 1 to 5. In the illustrations, an embedded type hooking ceiling 12 is provided on an apparatus fitting surface such as a ceiling of a room, and an adaptor 13 is electrically and mechanically connected to a lower surface of this hooking ceiling 12. A pair of locking claws 14 are provided in both sides of the adaptor 13 to always protrude by a built-in spring, and a releasing button 15 is protrusively provided on a lower surface thereof. When the releasing button 15 is operated to be pushed into the adaptor 13, the pair of locking claws 14 are made to retreat inwardly. A connector 16 is fitted through a connecting cord 17 to the adaptor 13.

Furthermore, the lighting apparatus has an apparatus body 21 which is formed so as to provide a disc-shaped configuration, and a recessed portion 22 is formed in the central portion thereof. An opening portion 23 is formed in the recessed portion 22 to allow the insertion of the adaptor 13. An elastic member 25 is fitted between the apparatus body 21 and the apparatus fitting surface 11, and an adaptor receiving member 26 is formed in a lower portion of the opening portion 23 of the apparatus body 21 so that the locking claws 14 of the adaptor 13 are engaged with both end portions of an inner wall surface of the apparatus body 21. In addition, on a lower surface of the apparatus body 21, there is formed a reflection surface portion 27 painted in white, which has a substantially downward light distribution peak.

A reflection member 31 formed with a hard-to-burn material of grade of approximately 5V is attached through a screw 32 to a lower surface of the apparatus body 21. This reflection member 31 is formed to have a circular configuration, and a holder fitting portion 33 having a recessed groove configuration is formed in radial directions, and a cylindrical portion 34 fitted over a lower edge portion of the adaptor receiving member 26 is formed to a central portion of the holder fitting portion 33 so as to be opened upwardly and downwardly, and an outer circumferential reflection surface portion 35 for performing the reflection in the circumferential direction of the apparatus body 21 is formed around the reflection member 31 to have a recessed curve surface configuration. That is, the peak of the light distribution of the reflected light from the outer circumferential reflection surface portion 35 is set in the circumferential direction.

Furthermore, an insertion hole 36 is formed in one end side of the holder fitting portion 33, that is, a holding surface 37 is formed in a lower surface side of this insertion hole 36 and a recessed surface 38 whose axial direction is defined along the width direction of the holder fitting portion 33 is formed to the upper surface side thereof. On the other hand, a pair of locking recessed portions 39 serving as locking means are formed in the other end side of the cylindrical portion 34 of the holder fitting portion 33 in the width directions in the opposed relation to each other, and a circular operating recessed portion 40 is further formed in a lower surface side of the locking recessed portion 39 to be made lower by one step than the portions around it.

Moreover, a connector 41 being an electric component is placed in the other end side of the holder fitting portion 33. That is, a substrate 42 having a generally C-like configuration is disposed within the interior of the apparatus body 21 covered by the reflection member 31, and the connector 41 as a non-heating component is protrusively placed in the vicinity of one end portion of the substrate 42, and heating components 43, 43 are located on both sides of the connector 41 so that the heat from the heating components 43, 43 is shut out by the connector 41 to prevent the heat from these heating components 43, 43 from interfering with each other or from heating up to an unnecessary degree by the multiplier effect. Besides, a remote control section 44 acting as a remote control unit or a mode change-over switch 45 is attached to the vicinity of a central portion of the apparatus body 21. Thus, the substrate 42 and the remote control section 44 or the mode change-over switch 45 are effectively attached within a small range, and the weight balance is also taken into consideration.

Moreover, locking members 47 for locking a shade 46 are symmetrically attached to the edge portion of the apparatus body 21 so that the shade 46 is detachable from the apparatus body 21, and a lever 48 is formed integrally with the locking member 47, and when the lever 48 is pulled, the shade 46 is detachable. Further, the shade 46 is not limited in configuration as long as it is formed of a material having a transparency and a diffusion permeability.

Furthermore, a string pulling arm 50 having a string insertion hole 49 for allowing the insertion of a pulling string, not shown, is fitted in a back surface side of the apparatus body 21 so that it can slide to extend and shrink to advance and retreat.

Still further, numerals 51, 52 designate circular fluorescent lamps, which are so-called T5 type having an emission arc tube 53 with a tube diameter of approximately 16 mm and are, for example, 40 W and 32 W types having outer diameters of 375 mm and 300 mm, respectively, and lamp pins, not shown, are also provided so as to project upwardly at an angle of 450 from a connector portion 54 set in one portion of the emission tube 53. By using such a thin T5 type, the circular fluorescent lamps 51, 52 do not interfere with each other, so that the circular fluorescent lamps 51, 52 can be placed in substantially horizontal directions, not in vertically shifted fashion.

As the emission arc tubes, there may be used two independent arc tubes having different diameters or a tube unit comprising two circular portions electrically connected to each other, both being arranged coaxially or concentrically.

Moreover, numeral 61 denotes a lamp holder member, which has a base portion 62 to be fitted in a central portion of the holder fitting portion 33, and an insertion portion 63 is formed to one end of the base portion 62. A projection surface 64 comprising a substantially the same curved surface as the recessed surface 38 for easy insertion is formed to an upper portion of this insertion portion 63. In addition, a locking claws 66 serving as a locking member locked by the locking recessed portion 39 and allowed to advance and retreat are placed at a position corresponding to the position of the locking recessed portion 39 closer to the central portion and the other end portion. The locking claw 66 is formed integrally with a button 67 for making it advance and retreat, and the button 67 is positioned at the operating recessed portion 40 at the mounting to be easily operable.

Furthermore, a pair of lamp sockets 71, 71 to be connected to the circular fluorescent lamps 51, 52 are provided on a lower surface of the other end of the base portion 62 protruded downwardly at an angle of approximately 45°. In addition, each of the lamp sockets 71, 71 is formed with connection holes, not shown, into which the lamp pins of the circular fluorescent lamps 51, 52 are inserted, and inside the connection holes, there are disposed pin receiving terminals.

A pair of holder portions 72 elastically fitted over the circumferences of the connector portions 54 are protrusively formed on the lamp socket 71, and the holder portion 72 has a length capable of being engaged with more than half portion of the circumferential surface of the connector portion 54 and has a circular arc having a diameter slightly smaller than the diameter of the connector portion 54 and has an elasticity. The line connecting the tip portions thereof is substantially perpendicular to the protruding direction of the lamp socket 71, and an opening portion 73 is provided so as to correspond to the inserting and detaching directions of the lamp pins into and from the lamp socket 71. In addition, these lamp pins are protrusively provided on the top surface of the lamp holder member 61 and are electrically connected to a plug 74 detachably fitted into the connector 41.

Moreover, lamp holders 76 for holding the emission arc tubes 53 of the circular fluorescent lamps 51, 52 are attached to a lower surface of one end of the base portion 62. In addition, these lamp holders 76 are formed of a resin having an elasticity and a light transmission property and a holder portion 78 is fitted over the inner sides and lower side portions of the emission tubes 53 to hold them.

Moreover, an adaptor accommodation portion 81 having a recessed configuration corresponding to the configuration in a radial direction of the adaptor 13 is formed for preventing the interfering with the adaptor 13. A bridge-shaped portion 82 is formed in a lower surface side of the adaptor accommodation portion 81 to slightly lower downwardly, and an operating hole 83 having a circular configuration for operating the releasing button 15 is formed to a central portion of this bridge-shaped portion 82.

Furthermore, the shade 46 has a light transmission property and is disposed to surround the entire lower surface of the apparatus body 21, and an opening portion 84 for setting the shade 46 on the apparatus body 21 is formed to a top surface of the shade 46, and a horizontal step portion 85 for engagement and separation with and from the locking member 47 is formed to an edge portion of the opening portion 84.

Still furthermore, a conical reflection cover 87 in which an accommodation portion 86 is formed in its top surface is placed on the lamp holder 61 positioned at the central portion of the apparatus body 21, and a recessed central reflection surface portion 88 for reflecting light in the direction of the outer circumference is formed to a lower surface of the reflection cover 87. In this instance, the light distribution peak of the reflected light from the central reflection surface portion 88 is set to the circumferential direction.

A reflection surface 89 is formed in combination with the body reflection surface portion 27 and the reflection member 31 of the apparatus body 21 and the central reflection surface portion 88 of the reflection cover 87.

On a lower surface of the apparatus body 21, arrows 90 are marked along the center line thereof at every 90°, and for example, in the case of fitting a directional shade such as a rectangular shade of a plane square configuration and a decorated shade, the positioning between the room configuration and the shade becomes easy in such a manner that the arrows are aligned with cross lines in a ceiling surface so as to be possible to prevent the shade from being fitted in misalignment manner with the room. The arrows 90 are marked by directly press-processing the apparatus body 21, marking thereon or by putting a seal thereon.

Figure 6:
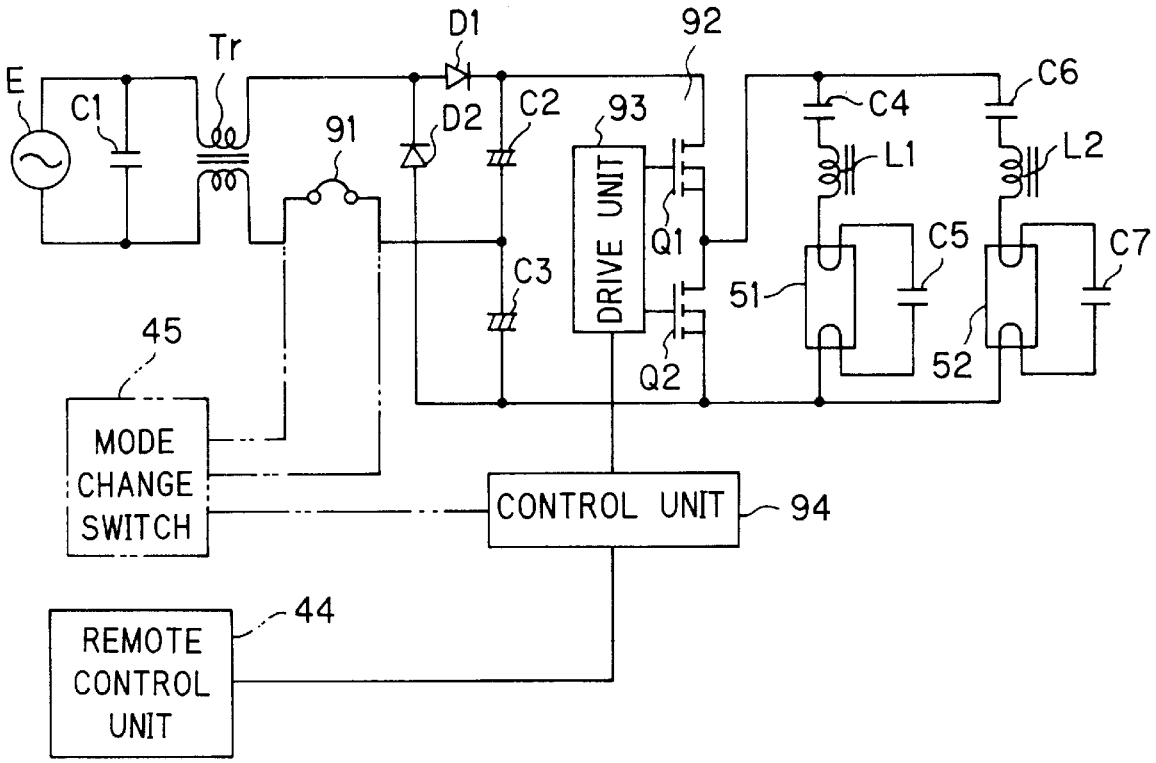
FIG. 6 is a circuit diagram showing a circuit arrangement in the lighting apparatus.

With reference to FIG. 6, a circuit arrangement of a control section arranged on a substrate 42 will be described hereunder.

FIG. 6 is a circuit diagram showing a circuit arrangement, where a capacitor C1 and a filter of a transformer Tr are coupled to a commercial AC power supply source E and connected through a jumper line 91 and a diode D1 to a capacitor C2. A series circuit comprising a capacitor C3 and a diode D2 is connected to both ends of these diode D1 and capacitor C2 to establish a voltage doubler circuit. In addition, a high-frequency lighting inverter circuit 92 serving as a lighting unit is connected thereto and further is coupled in series to two field effect transistors Q1, Q2 which in turn, are under control of a drive unit 93. This drive unit 93 comes under the control of a remote control unit 44 through a control unit 94. Further, a capacitor C4, a choke coil L1 and the circular fluorescent lamp 51 are coupled in series between both terminals of the field effect transistor Q2, and a starting capacitor C5 is connected to a portion between both ends of the circular fluorescent lamp 51. A capacitor C6, a choke coil L2 and the circular fluorescent lamp 52 are coupled in series to a portion therebetween, and a starting capacitor C7 is connected to a portion between both ends of the circular fluorescent lamp 52.

Furthermore, the voltage of the commercial AC power supply source E is rectified by the diode D1 and the diode D2 and charged in the capacitor C2 and the capacitor C3, and the drive unit 93 controls the field effect transistors Q1, Q2 through the control unit 94 in accordance with the state set through the remote control unit 44 to light the circular fluorescent lamps 51, 52.

In place of the remote control unit 44, a mode change-over switch 45 such as a pull switch may be used. In this instance, the jumper line 91 is removed to provide an open condition.

Further, it is to be noted that another circuit arrangement may be utilized for the present invention as described hereinafter with reference to FIGS. 23 to 33.

The above-mentioned embodiment will be operated in the following manner.

In attaching the apparatus body 21 to the apparatus fitting surface 11, the adaptor 13 is fitted in the hooking ceiling 12, and the apparatus body 21 is pushed up in a state with being aligned with the lower portion of the adaptor 13 so that the apparatus body 21 is fitted over the outside of the adaptor 13. The locking claws 14 projecting from the side surface of the adaptor 13 are engaged with the adaptor receiving member 26, resulting in that the apparatus body 21 is supported by the adaptor 13.

In accordance with the fitting state of the apparatus body 21, a power source is arranged in the interior of the apparatus body 21 through the hooking ceiling 12 and the adaptor 13.

The projection surface 64 of the insertion portion 63 of the lamp holder 61, to which the circular fluorescent lamps 51, 52 are attached, is brought into contact with the recessed surface 38 of the insertion hole 36 so as to be inserted thereinto and slides in a state that the contact portion between the projection surface 64 of the insertion portion 63 of the lamp holder member 61 and the recessed surface 38 of the insertion hole 36 substantially serves as a supporting point, and at the same time, the lamp holder member 61 is rotated so as to be fitted and inserted into the holder fitting portion 33 of the reflection member 31 from the lower side, so that the locking claws 66 are locked with the inner side of the locking recessed portion 39 for achieving the fitting thereof. At this time, the plug 74 is fitted and inserted into the connector 41 to establish the electrical connection thereto. Further, the reflection cover 87 is fitted to the central portion of the apparatus body 21.

The shade 46 is covered from below the apparatus body 21 and pushed upwardly, so that the shade 46 is placed through the respective locking members 47 of the apparatus body 21.

The large-diameter circular fluorescent lamp 51 is in the opposed relation to the outer circumferential reflection surface portion 55, which reflects the light from the circular fluorescent lamp 51 in the circumferential direction to light up this direction, and on the other hand, the small diameter circular fluorescent lamp 52 mainly lights up the central portions and near owing to the reflection on the central reflection surface portion 87 of the reflection cover 87, and even if the circular fluorescent lamps 51, 52 are of the thin type which has a large light output per unit area, it is possible to reduce the lamp image through the shade 46.

Furthermore, at the replacement of the lamp, the locking of the respective locking members 47 are released and the shade 46 is removed from the apparatus body 21, and the reflection cover 87 is taken out from the apparatus body 21. The locking of the locking claws 66 is released in a manner that both the sides of the base portion 62 of the lamp holder member 61 are held and the lamp holder member 61 is moved downwardly to be detached from the reflection member 31, and the insertion portion 63 of the lamp holder member 61 is pulled out from the insertion hole 36 to take out the lamp holder member 61.

Further, the emission arc tubes 53 of the circular fluorescent lamps 51, 52 are detached from the lamp holder 76 by detaching the lamp holder member 61, and then the lamp pins of the connector portions 54 are separated from the lamp sockets 71. Thereafter, the lamp pins of the connector portions 54 of new circular fluorescent lamps 51, 52 are set to the lamp sockets 71 and subsequently the emission arc tubes 53 are set to the lamp holder 76, thus completing the replacement. As mentioned above the, when lamp pins of the connector portions 54 of the circular fluorescent lamps 51, 52 are fitted in the lamp sockets 71 and then the emission tubes 53 are set to the lamp holder 76, the circular fluorescent lamps 51, 52 are fitted to the lamp holder member 61 without applying the stress to the lamp pins.

Furthermore, the remote control unit is operated for lighting the circular fluorescent lamps 51, 52 and a signal such as an infrared ray signal transmitted from the remote control unit is received to control the output of the inverter circuit 92, thereby setting the lighting, light control and light putting-out.

Figure 7:
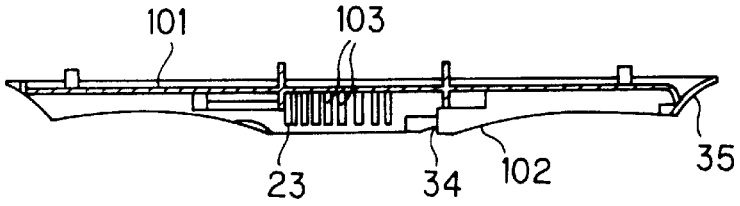
FIG. 7 is a cross-sectional view showing a modified structure of a reflection member applied to the lighting apparatus of FIG. 1.
Figure 8:
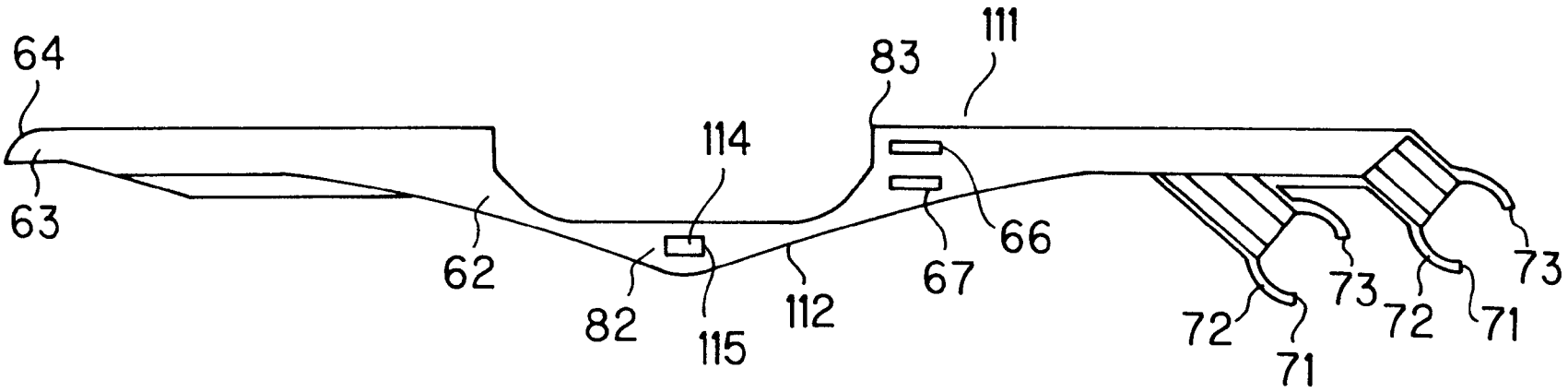
FIG. 8 is a side elevational view showing a lamp holder member of the lighting apparatus of FIG. 1.
Figure 9:
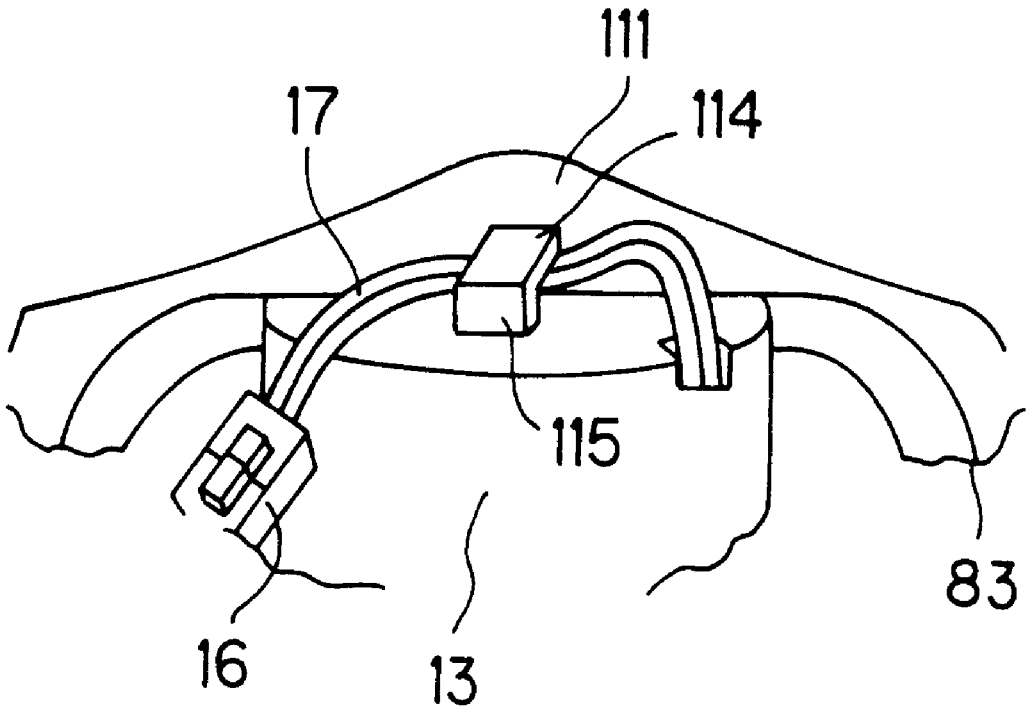
FIG. 9 is a perspective view showing a state that a cord is pressed by the lamp holder member.

With reference to FIGS. 7 to 9, a modified example of the above embodiment will be described hereunder, in which FIG. 7 is a cross-sectional view showing a reflection member, FIG. 8 is a side elevational view showing a lamp holder and FIG. 9 is a perspective view showing the state of the lamp holder pressing a cord.

A reflection member 101 shown in FIG. 7 is formed such that, in the reflection member 31 of the embodiment shown in FIGS. 1 to 6, a central reflection surface portion 102 for reflecting light in the circumferential direction is integrally formed around the cylindrical portion 34 of the central bridge portion 82, and a lamp holder 111 shown in FIG. 8 is formed such that, in the lamp holder member 61 of the embodiment shown in FIGS. 1 to 6, a central reflection portion 112 having substantially isosceles triangular configuration is integrally formed in the central portion to reflect light in the circumferential direction similar to a slope corresponding to the central reflection surface portion 102, with the light being reflected by the central reflection portion 102 and the central reflection portion 112 toward the outer peripheral direction. This arrangement makes it not necessary to locate the different reflection cover 87, to make easy the fitting operation, to reduce the size of the arrangement, and to reduce the number of parts or components.

Radiation holes 103 are formed so as to communicate with and open to the portion around the central opening portion 23 of the reflection member 101, particularly in the vicinity of the heating component 43 in opposed relation to the adaptor 13. In addition, due to the heating of the heating component 43, the heat radiates through the radiation holes 103 and further radiates toward the external portion through the gap between the reflection member 101 and the adaptor 13. Furthermore, since the radiation holes 103 are formed in the surface facing the adaptor 13 but not made in the lower surface of the reflection member 101, the radiation holes 103 are not visible from the below, thereby maintaining the beautiful appearance and keeping the reflection area of the reflection member 101. Further, since these holes are formed laterally, the radiation effect is higher as compared with the case of being formed in the lower surface.

Moreover, a cord pressing portion 114 is protrusively formed to a side surface of the lamp holder 111, and a hooking portion 115 is formed at the tip portion of the cord pressing portion 114 by being bent toward the reflection member 101 side. Further, when the lamp holder member 111 is fitted to the reflection member 101, the cord 17 of the adaptor 13 is hooked by the hooking portion 115, for example, as shown in FIG. 9, and pressed by the cord pressing portion 114, thereby preventing the cord 17 from being positioned on the front surface side of the reflection member 101. Accordingly, it is possible to prevent the cord 17 from protruding to shut out the light from the circular fluorescent lamps 51, 52, thereby preventing the shadow of the cord 17 to eliminate the cord image, thus obtaining the uniform illumination.

A further modified example will be described with reference to FIG. 10, in which, in an upper portion of the apparatus body 21, a cord 121 mechanically suspended for an electric connection is connected in place of the adaptor 13, and a dome 122 is attached to the apparatus body 21 in the proximal side of the cord 121, which is held by a locking member 123 fitted in an insertion hole, not shown, of the dome 122, with the cord 121 being set to an arbitrary length. In addition, a ceiling cap 124 to be connected to the ceiling 12 shown in FIG. 1 is connected to the tip portion of the cord 121.

Furthermore, a shade 125 having an opened lower surface is attached to the apparatus body 21. Further, the shade 125, having an opening 126 slightly smaller than the plane configuration of the apparatus body 21, is formed in an upper portion. The edge portion of the opening 126 is put on the apparatus body 21 and attached thereto.

Figure 10:
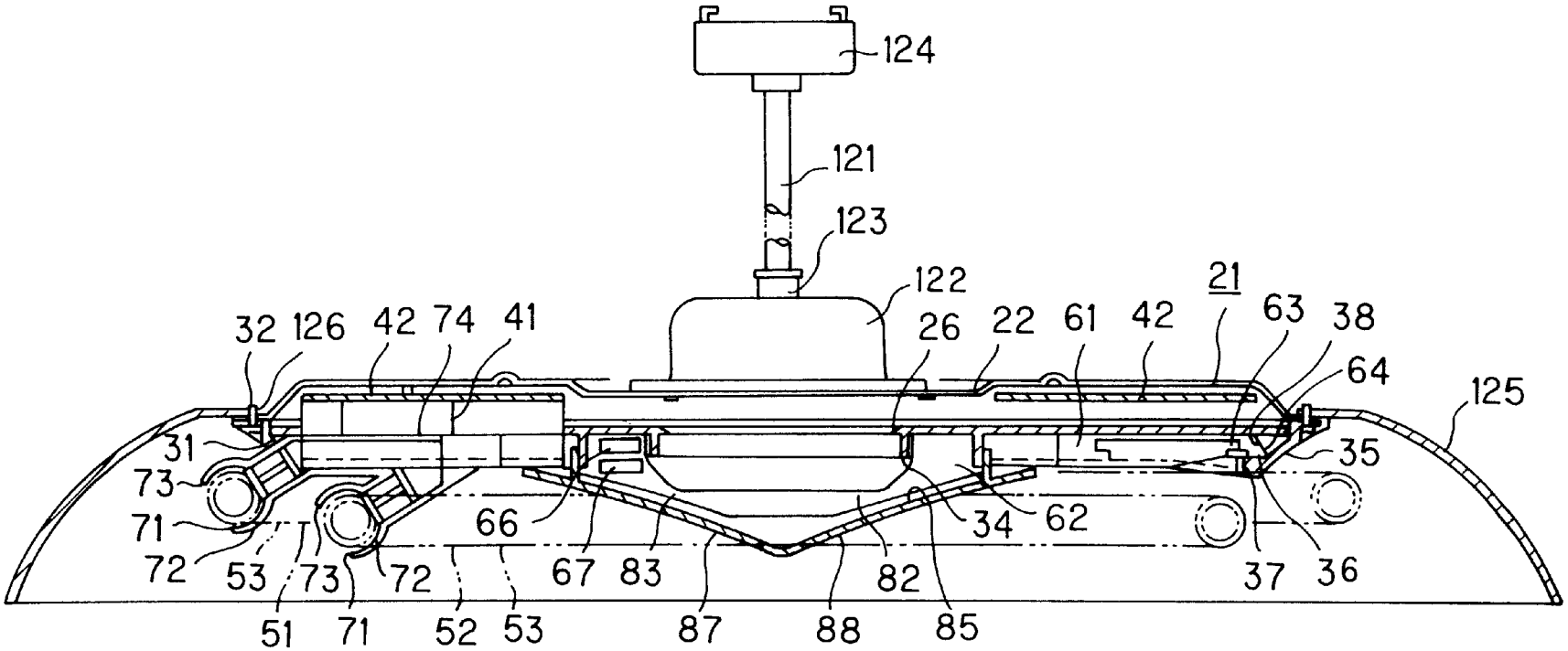
FIG. 10 is a cross-sectional view showing a lighting apparatus according to a second embodiment of the present invention.

It is noted that the most of parts such as the apparatus body 21 shown in FIG. 10 are substantially common to the components of the directly ceiling-attached type apparatus, and by partially replacing the components, the apparatus can be constructed as the directly ceiling attached type or the pendant type without greatly increasing the kinds of parts or components.

Figure 11:
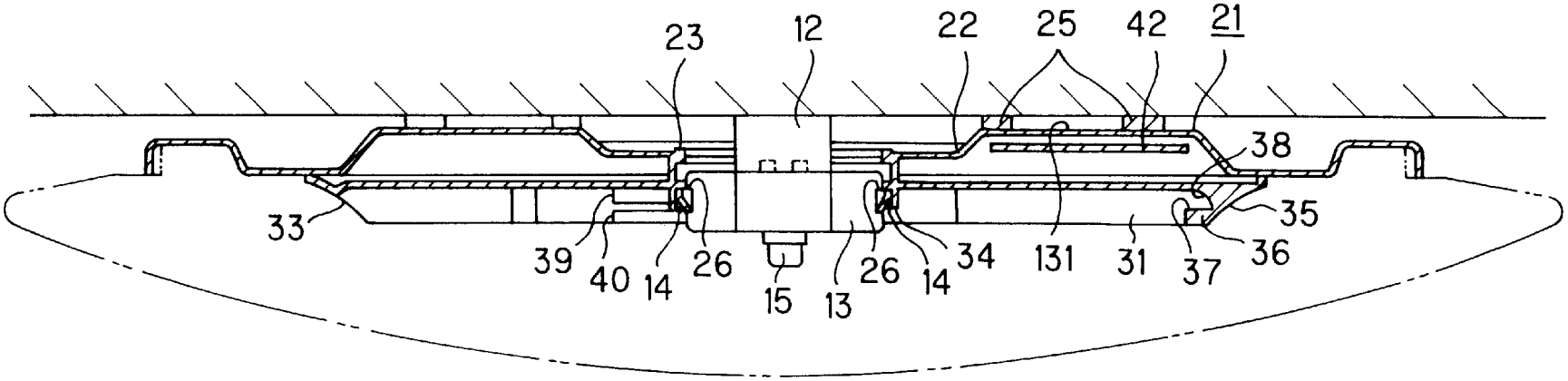
FIG. 11 is a cross-sectional view showing a lighting apparatus according to a third embodiment of the present invention in which a holder member is removed.
Figure 12:
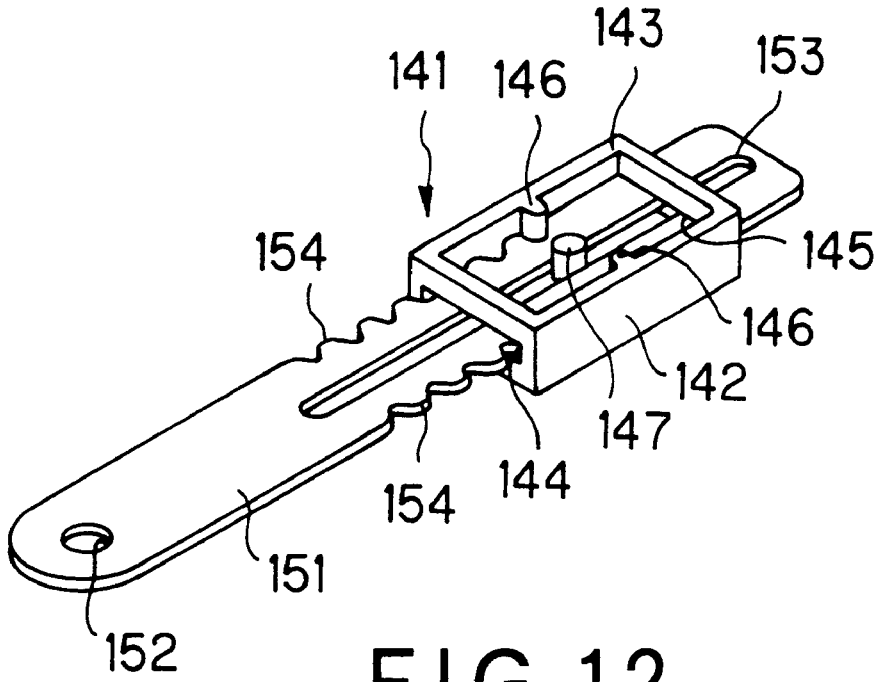
FIG. 12 is a perspective view showing a string pulling arm device.

Still furthermore, FIG. 11 is a cross-sectional view showing a lighting apparatus according to a third embodiment of the present invention in which the holder member is removed. The lighting apparatus of FIG. 11 is formed such that, in the lighting apparatus of FIG. 3, an expanded portion 131 swelled toward the ceiling is formed in the top surface side of the apparatus body 21 and the lower surface of the reflection member 31 is formed to have substantially a flat surface configuration and the space between the expanded portion 131 of the apparatus body 21 and the reflection member 31 is enlarged to accommodate the substrate 42 which is not of a thin type but has a common thickness so as to reduce the manufacturing cost. In addition, In consideration of the irregularities on the ceiling surface, the expanded portion 131 is formed to define a gap between the expanded portion 131 and the ceiling.

Figure 3:
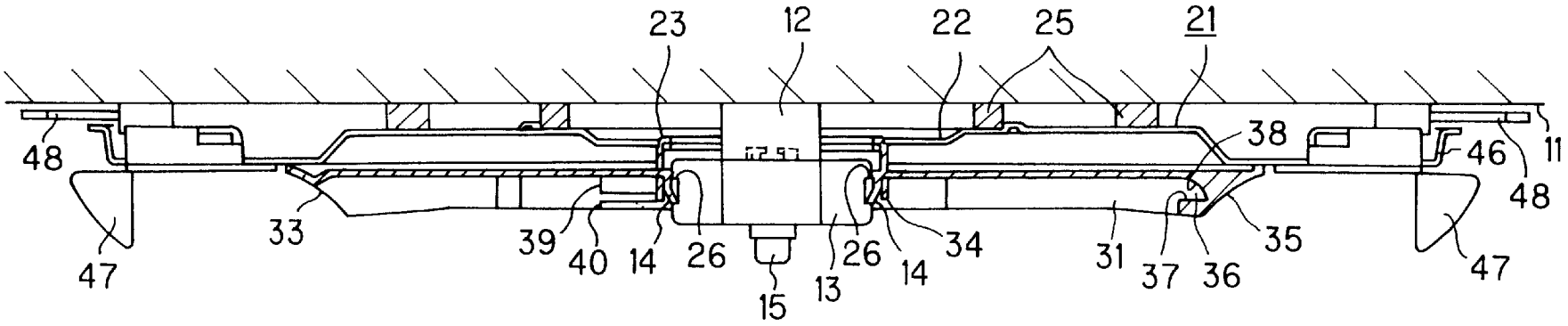
FIG. 3 is a cross-sectional view showing the lighting apparatus of FIG. 2 from which a shade and a holder member are detached.
Figure 4:
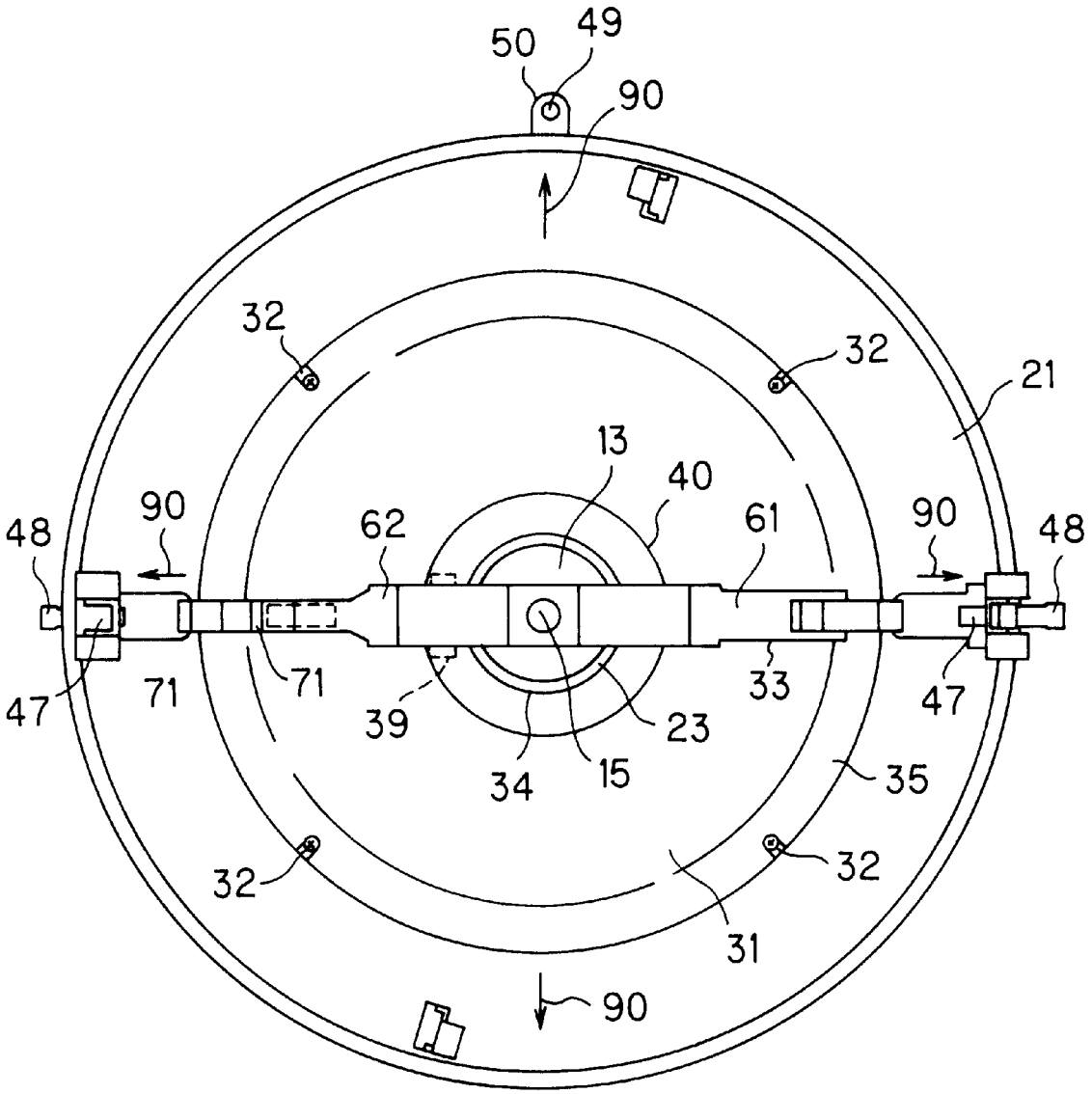
FIG. 4 is a front elevational view showing the lighting apparatus of FIG. 1 from which a shade and a fluorescent lamp are detached.
Figure 5:
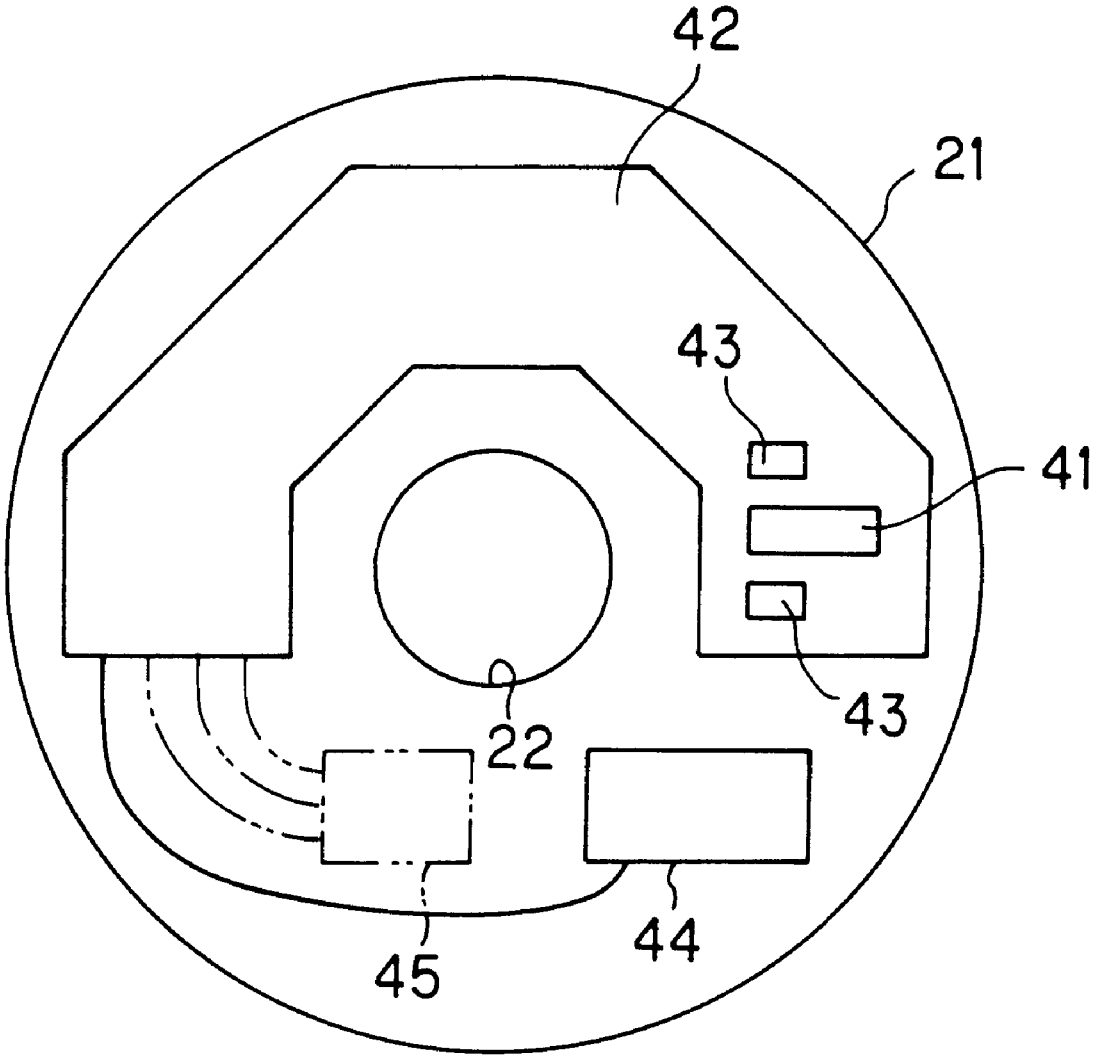
FIG. 5 is an illustrative elevational view showing an arrangement of a circuit substrate in the lighting apparatus.

Since the expanded portion 131 is formed in the top surface side of the apparatus body 21, there is no need to increase the thickness thereof viewed from the lower surface side, and therefore, it is possible to visually maintain the thin configuration, and since the lower surface of the reflection member 31 is only formed to provide a flat surface configuration, the reflection characteristic does not sharply vary as compared with the lighting apparatus shown in FIG. 3.

Next, with reference to FIGS. 12 to 15, the string pulling arm device 141 is provided with a thin-box-like holding member 142, which has an opening portion 143 in its top surface and also has insertion holes 144, 145 at both end portions in the longitudinal direction thereof. In addition, locking projections 146, 146 are protrusively formed in the opposed relation to each other at intermediate portions of both sides of the inner surface of the holding member 142 in the longitudinal direction thereof. A rotational shaft 147 is protrusively formed between the locking projections 146, 146 to which the holding member 142 is fitted to be rotatable with respect to the apparatus body 21.

On the other hand, an elongated plate-shaped string pulling arm 151 is inserted into the insertion holes 144, 145 of the holding member 142 to be allowed to advance and retreat, and a pulling string insertion hole 152 for allowing the insertion of a pulling string, not shown, is formed in the tip portion of the string pulling arm 151, and a sliding hole 153, into which the rotational shaft 147 is inserted along the longitudinal direction of the string pulling arm 151, is formed in the base portion side of the string pulling arm 151. The string pulling arm 151 is fitted to be slidable along the longitudinal direction by a length corresponding to the length of the sliding hole 153, and locking recessed sections 154, 154 having a wave-shaped configuration are formed in both the sides thereof in the longitudinal direction, with the locking recessed portions 154, 154 being locked with the locking projections 146, 146 at a plurality of positions.

Figure 13:
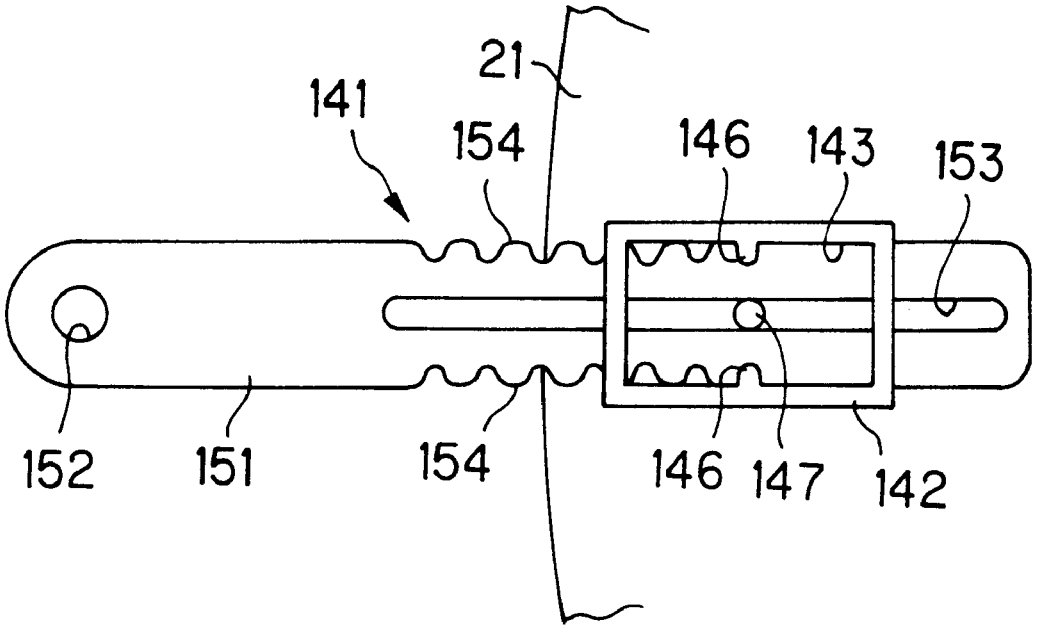
FIG. 13 is a plan view showing the string pulling arm device in which a string pulling arm is pulled out.

In the case of using the string pulling arm 151 in the longest condition, as shown in FIG. 13, the most proximal portion of the locking recessed portion 154 is engaged with the locking projection 146 in a state that the string pulling arm 151 is maximally pulled out and the string pulling arm device 141 is set to be positioned along the diameter direction of the apparatus body 21.

Figure 14:
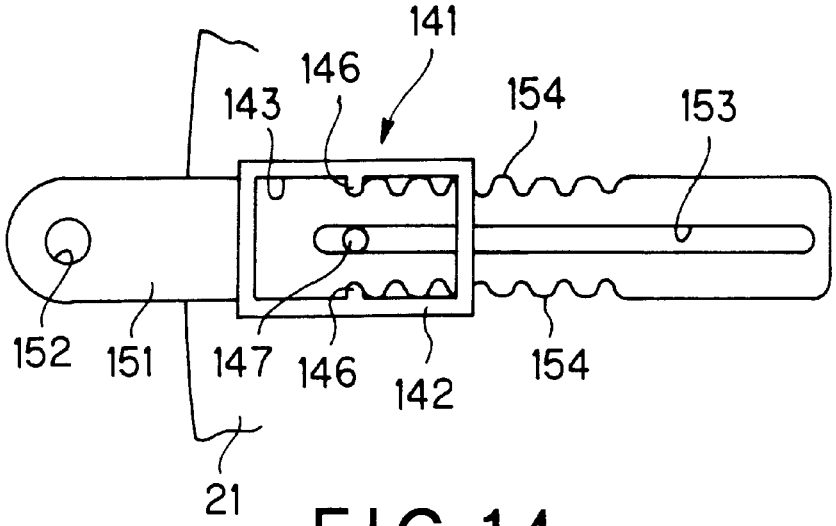
FIG. 14 is a plan view showing the string pulling arm device in which the string pulling arm is housed.

On the other hand, in the case of using the string pulling arm 151 in the shortest condition, as shown in FIG. 14, the most tip portion side of the locking recessed portion 154 is engaged with the locking projection 146 in a state that the string pulling arm 151 is housed as much as possible and the string pulling arm device 141 is set to be positioned along the diameter direction of the apparatus body 21.

Figure 15:
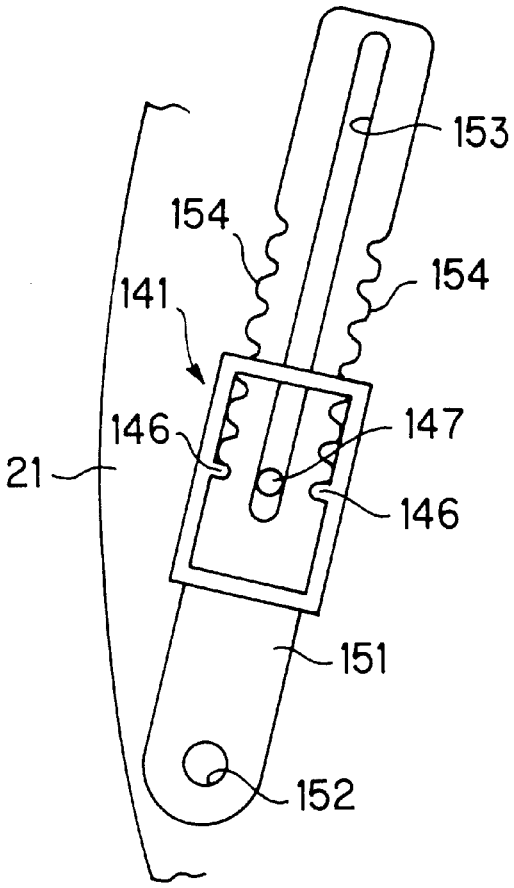
FIG. 15 is a plan view showing a state that the string pulling arm device is rotated.

Furthermore, in the case of housing the string pulling arm 151, as shown in FIG. 15, the string pulling arm device 141 is rotated in a state that the string pulling arm 151 is encased to the end, and the string pulling arm 151 is positioned in a direction perpendicular to the diameter direction of the apparatus body 21 so that the string pulling arm 151 is not protruded from the apparatus body 21.

Furthermore, when making the string pulling arm device 141 rotatable, even if a sufficient clearance of the sliding of the string pulling arm 151 can not be ensured because there exists the expanded portion 131, for example, which protrudes toward the proximal end side of the string pulling arm 151, the string pulling arm 151 can be housed so as not to protrude from the apparatus body 21. In addition, because the string pulling arm device 141 is designed to be rotatable, when the string pulling arm 151 is held to rotate the apparatus body 21, it is possible to prevent an unnecessary force from being applied to the string pulling arm 151 and it is possible to prevent the apparatus body 21 from being damaged due to the unnatural rotation of the apparatus body 21. Moreover, since the string pulling arm 151 is capable of advancing and retreating, as compared with one merely rotatable, it is possible to change the protrusion amount and hence to make an arbitrary shade cope with the length of the string pulling arm 151.

Figure 16:
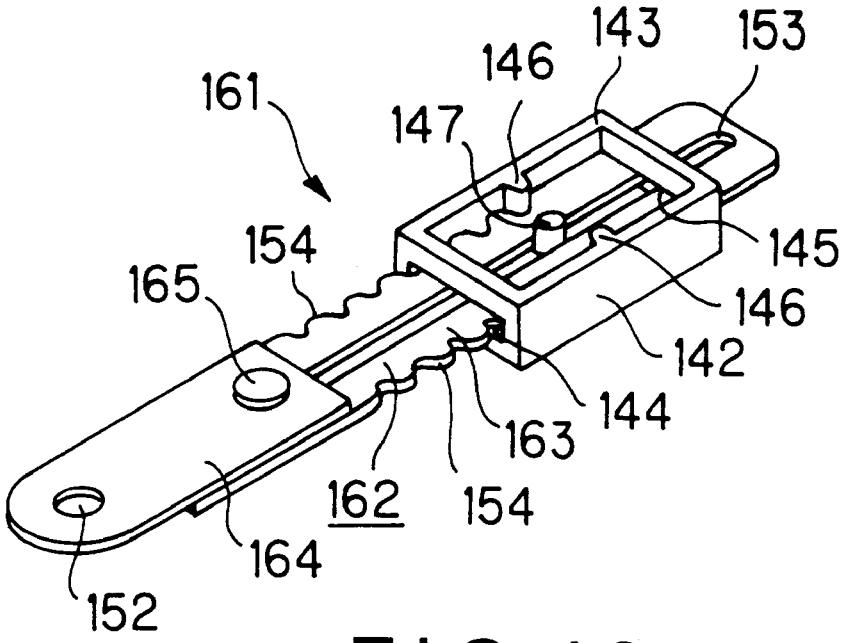
FIG. 16 is a perspective view showing a string pulling arm device according to another example.
Figure 17:
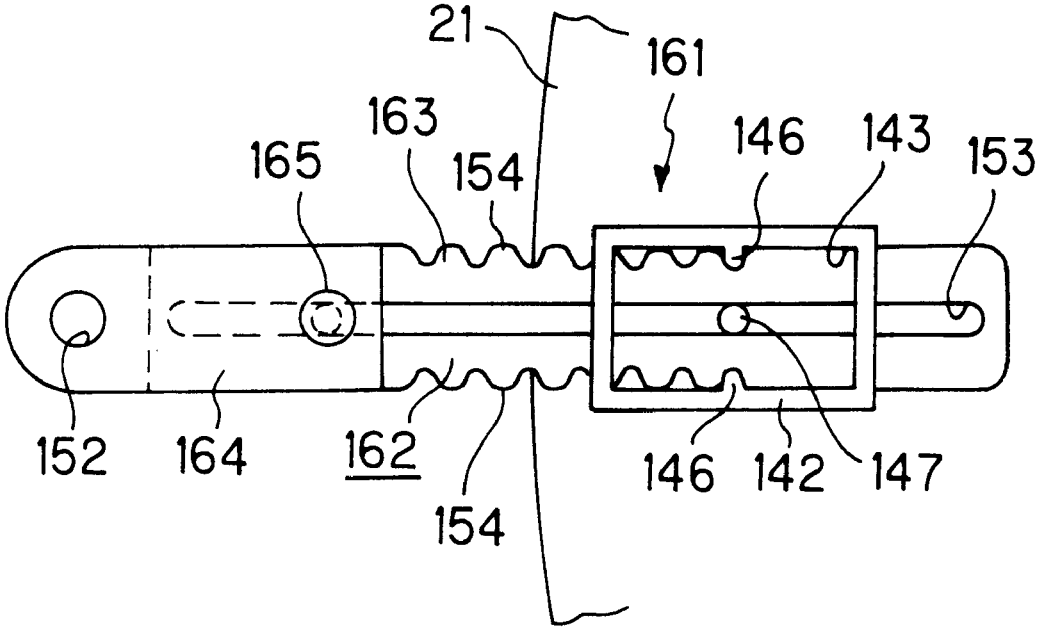
FIG. 17 is a plan view of the string pulling arm device of FIG. 16.

Another example of the string pulling arm device will be described hereunder with reference to FIGS. 16 and 17, in which FIG. 16 is a perspective view showing a string pulling device of the another example and FIG. 17 is a plan view thereof. The string pulling arm device 161 shown in FIGS. 16 and 17 is formed such that, in the string pulling arm device 141 shown in FIGS. 12 to 15, a string pulling arm 162 is composed of a base portion 163 and a tip portion capable of advancing and retreating with respect to the base portion 163. Further, a sliding slit 153 of the base portion 163 is formed throughout substantially the overall length of the string pulling arm 162, and a tip portion 164 is attached to the tip portion side of the sliding slit 153 to be slidable and rotatable by the rotational shaft 163.

Thus, the string pulling arm 162 is divided into two portions, i.e., the base portion 163 and the tip portion 164 so that the base portion 163 is fitted to be rotatable and slidable with respect to the tip portion 164.

Thus, when the base portion 163 and the tip portion 164 are piled up each other, it is possible to further shorten the string pulling arm 162 and hence to make it compact.

Figure 18:
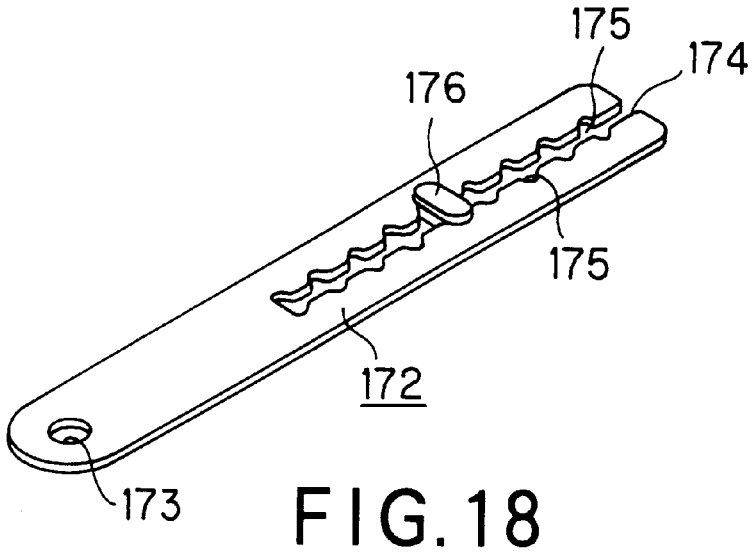
FIG. 18 is a perspective view showing a string pulling arm device according to a further example.

FIG. 18 shows a further example of the string pulling arm device according to the present invention, in which the string pulling arm device is formed such that a pulling string insertion hole 173 is formed to the tip portion of a string pulling arm 172, and a longitudinal sliding slit 174 formed to the base portion side of the pulling string insertion hole 173 along the longitudinal direction so that the base portion side is opened, and wave-shaped locking recessed portions 175, 175 are formed in the opposed relation to each other in both sides of the sliding slit 174 in the longitudinal direction thereof. Further, the sliding slit 174 is engaged with a rotational shaft protrusively provided in the apparatus body 21 and therefore a string pulling arm 172 is rotated about the rotational shaft 176, and the protruding amount of the string pulling arm 172 is made variable.

Thus, if being constructed with only the string pulling arm 172 and the rotational shaft 176, the string pulling arm device 171 can be formed with a simple structure.

Figure 19:
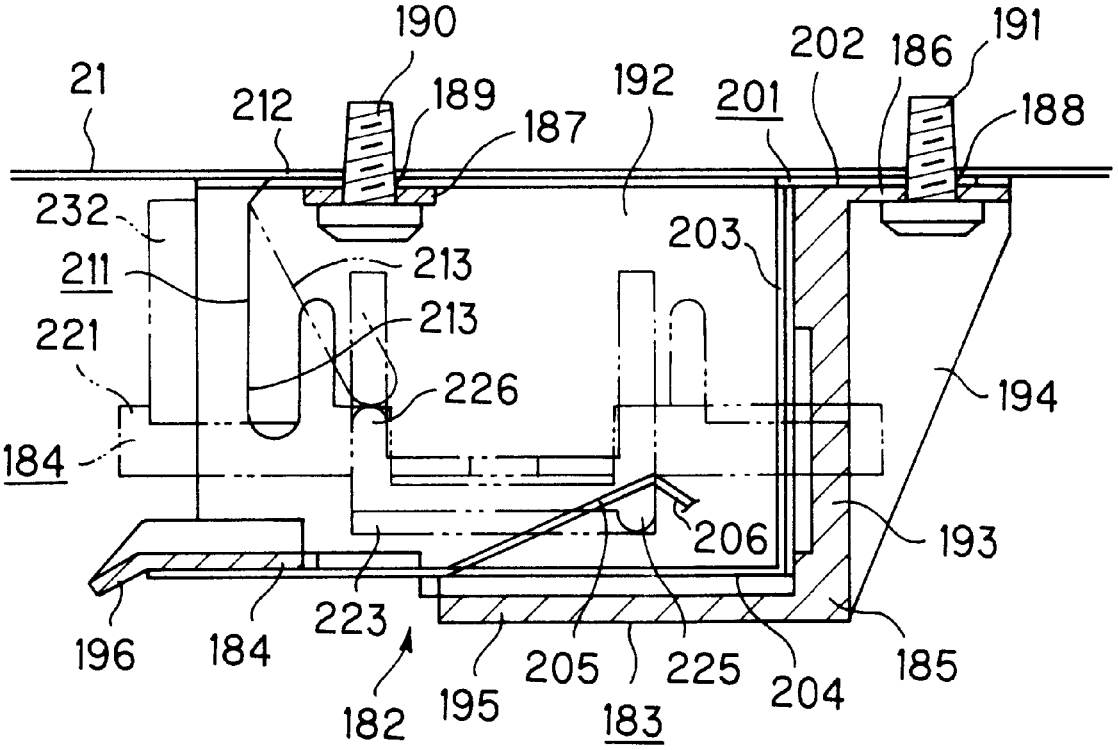
FIG. 19 is a front elevational view showing a shade fitting device.
Figure 20:
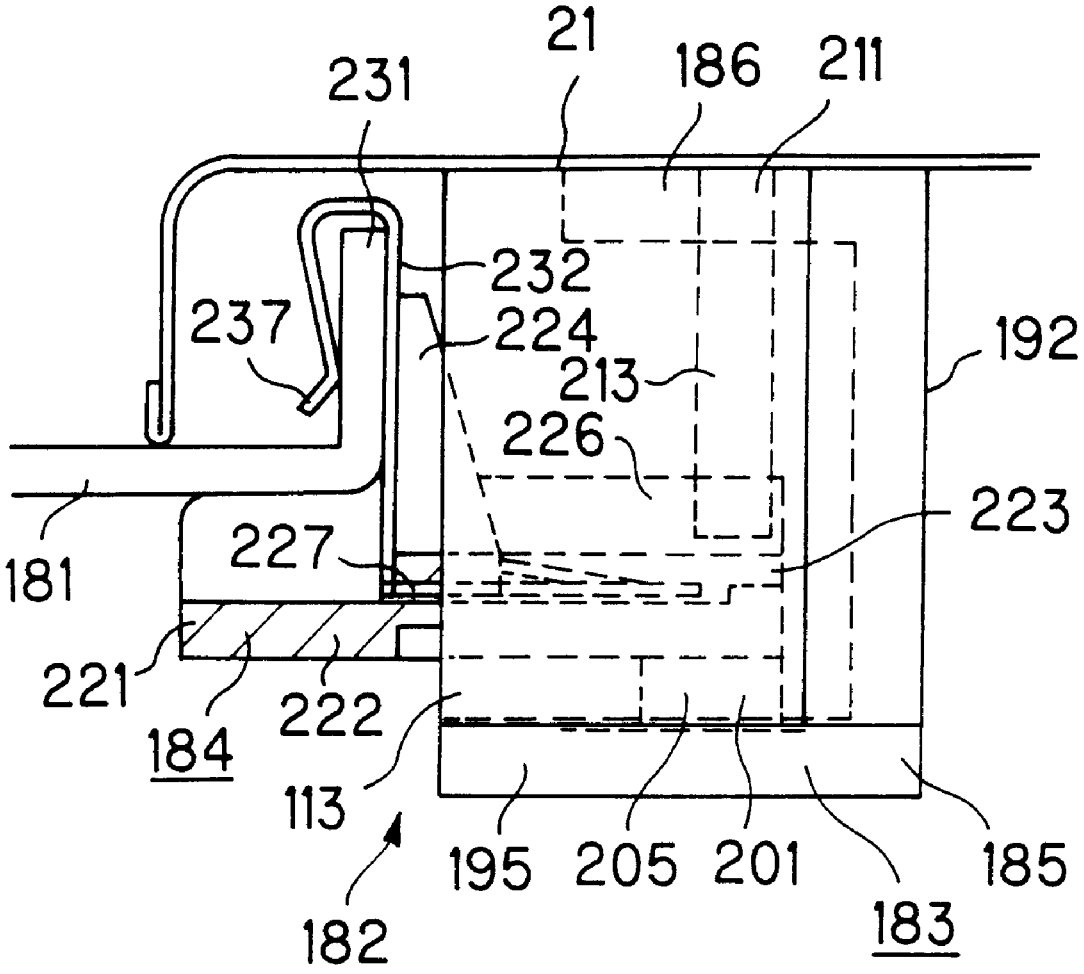
FIG. 20 is a side elevational view of the shade fitting device of FIG. 19.
Figure 21:
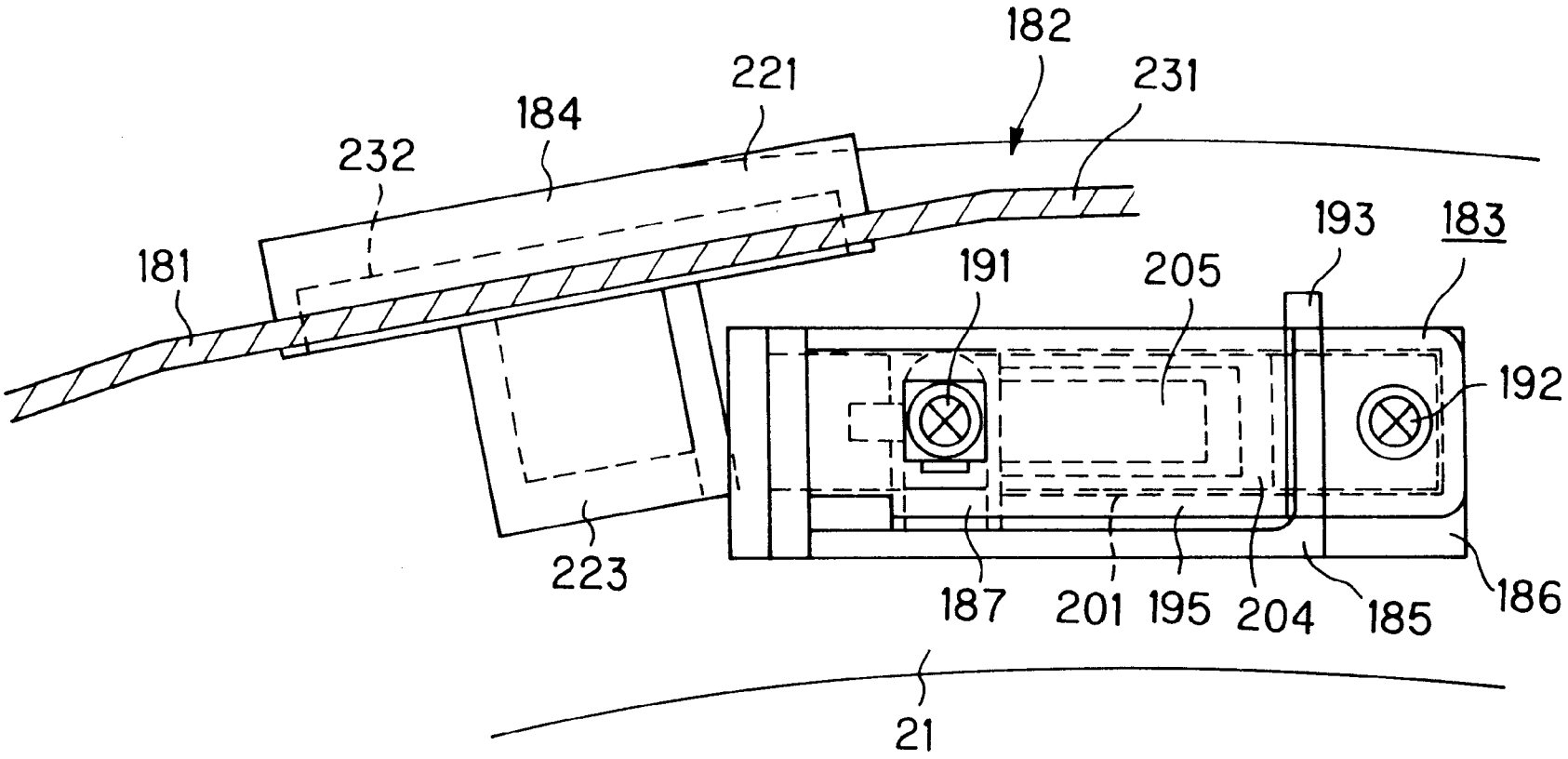
FIG. 21 is a plan view showing the shade fitting device before a shade is fitted.
Figure 22:
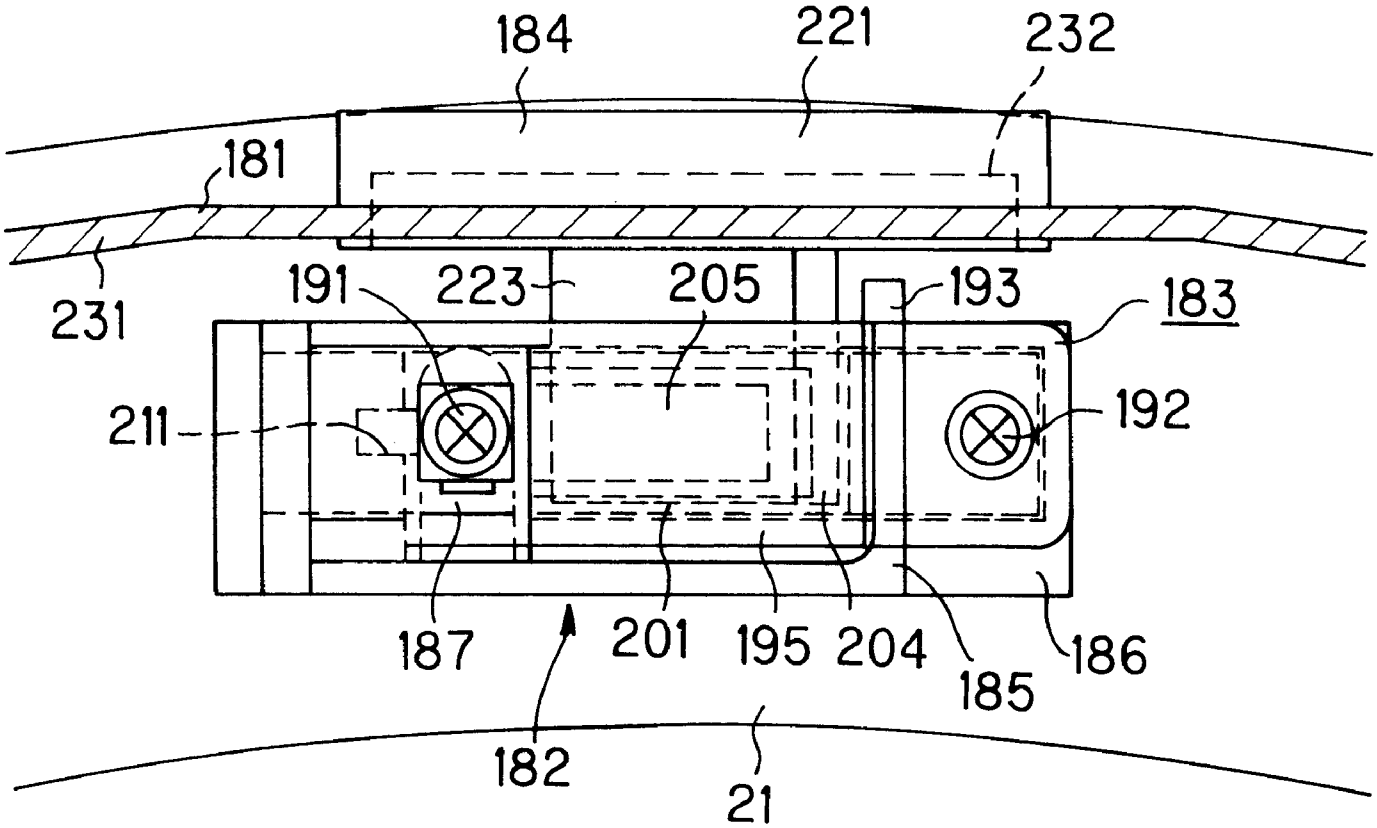
FIG. 22 is a plan view showing the shade fitting device after the shade is fitted.

FIG. 19 is a front elevational view showing a shade fitting device, FIG. 20 is a side elevational view thereof, FIG. 21 is a plan view showing the shade fitting device which is in a state before the fitting of the shade, and FIG. 22 is a plan view showing the shade fitting device which is in a shade attached condition.

Furthermore, a shade 181 serving as a light controlling means is fitted to the apparatus body 21 by means of shade fitting devices 182 disposed at three portions at every 120°. As shown in FIGS. 19 to 22, this shade fitting device 182 is equipped with a supporting member body 183 attached to the apparatus body side and a receiving member 184 fixed to the shade 191 supported by the supporting member body 183.

The supporting member body 183 has a resin-made base member 185, which is provided with a fitting surface portion 186 and a fitting piece portion 187, and screw insertion holes 188, 189 are formed to in the fitting surface portion 186 and the fitting piece portion 187, respectively, so that screws 190, 191 are inserted into these screw insertion holes 188, 189 to secure them to the apparatus body 21. In addition, a side wall portion 192 and an end wall portion 193 are formed vertically to the fitting surface portions 186 and 187, and a reinforcing rib 194 is further formed to the end wall portion 193. A supporting portion 195 is formed so as to cover the tip portions of the side wall portion 192 and the end wall portion 193, and a tapered guide portion 196 is formed in the insertion side opposite to the end wall portion 193. Further, the outer circumferential side and the insertion side of the apparatus body 21 have opened configurations, and the opening in the inserting direction is directed to the same direction as the circumferential direction of the apparatus body 21.

Moreover, a metal-made spring member 201 having an elasticity is attached to the base member 185. The spring member 201 has a grasped portion 202 receiving a screw 191 and grasped between the base member 185 and the apparatus body 21, and a vertical portion 203 is formed by bending it from the grasped portion 202 at a right angle, while a supporting piece portion 204 positioned above a supporting portion 195 is formed by bending it from the other end side in a direction opposite to the grasped portion 202. A pressing portion 205 for preventing the falling-out is formed to the supporting piece portion 204 by cutting and raising, and a bent portion 206 is formed at the tip portion of the pressing portion 205.

To the base member 185 there is attached a metal-made sound generating member 211 with an elasticity which generates a sound and gives a click feeling due to the deformation occurring when inserted and detached with the sound generating member 211 being held between the fitting piece portion 187 of the base member 185 and the apparatus body 21 and having a grasping portion 212 into which a screw 190 is inserted. A sound generating portion 213 is formed by being bent from the grasping portion 212 to have a U-shaped configuration.

On the other hand, the receiving member 184 is formed with a resin-made base member 221 which in turn, has an elongated plane portion 222, and in a central portion of the plane portion 222 there is formed a receiving surface portion 223 which is in parallel to the plane portion 222. Further, a vertical surface portion 224 is protrusively formed in a direction perpendicular to the receiving surface portion 223, and a locking projection 225, by which the pressing portion 205 of the spring member 201 is locked to a lower surface of the tip portion side of the receiving surface portion 223 in the insertion direction, is protrusively formed in a direction normal to the insertion direction. A sound generating projection 226 coming into contact with the sound generating member 211 is further protrusively formed on the rear end side top surface of the receiving surface portion 223 to extend in a direction perpendicular to the insertion direction. Moreover, an insertion opening 227 having a small width in the vertical direction is formed to the receiving surface portion 223 to extend in a direction perpendicular to the insertion direction.

Furthermore, a circular wall section 232 for holding a circular wall portion 231 is formed by raising around the shade 181. In addition, a metal-made stopping member having an elasticity is attached to the base member 221. The stopping member 232 has an insertion portion 234 which is inserted into the insertion opening 227 of the receiving surface portion of the base member 221, and a raised portion 235 raised in a direction opposite to the insertion direction is formed in the insertion section 234, thereby preventing the stopping portion 232 from falling out unnecessarily. In addition, in the insertion section 234, there is formed a U-shaped grasp section 236 bent along the vertical surface portion 224 at right angles for holding the circular wall portion 231 of the shade 181. A tapered portion 237 is bent and formed at the tip portion of the grasp section 236.

An operation of attaching and detaching the shade 181 to and from the apparatus body 21 will be described hereunder.

First, in the case of attaching the shade 181 to the apparatus body 21, the upper portion of the shade 181, which has an opening, is brought into contact with the apparatus body 21 and the shade 181 is then rotated with respect to the apparatus body 21.

Subsequently, the receiving surface portion 223 of the receiving member 184 is inserted against the biasing force of the pressing portion 205 of the spring member 201, while being guided by the guide section 196 of the supporting member body 183 and the receiving surface portion 223, and when the locking projection 225 of the receiving surface portion 223 gets over the bent portion 206 at the tip portion of the pressing portion 205, it is biased upwardly by the pressing portion 205 and the locking projection 225 is locked by the bent portion 206 to prevent it from rotating in the reverse direction. The shade 181 is then rotated in a direction opposite to the insertion direction so that the shade 181 is prevented from falling out, and even the shade 181 is pressed toward the apparatus body 21 so as to prevent a gap from remaining between the shade 181 and the apparatus body 21. Incidentally, at the time of the completion of the mounting, the receiving member 184 is positioned on the right side with respect to the state shown in FIG. 19.

Next, in the case of detaching the shade 181 from the apparatus body 21, the shade 181 is slightly pressed toward the apparatus body side to reduce the biasing force of the pressing portion 205 of the spring member 201 against the locking projection 225. The shade 181 is then rotated in a direction opposite to the insertion direction, and on the other hand, the receiving member 184 is detached from the supporting member body 183.

Although in the above-described embodiments the reflection cover and the lamp holder member are separately formed, even if the reflection cover is integrally attached to the lamp holder member, substantially the same effects as those mentioned above are obtainable, and further the operation becomes easy because the attaching and detaching operations can integrally be done.

In addition, it may be possible to form the apparatus body so as to change the distance between the lamp socket 71 and the lamp holder 76, and if the distance between the lamp socket 71 and the lamp holder 76 is changeable, it is possible to arrange the circular fluorescent lamps 51, 52 to be fitted regardless of the difference in sizes thereof. Moreover, in the case where an interlocking mechanism is provided in the lamp socket 71 and the lamp holder 76 and the centers of the lamp socket 71 and the lamp holder 76 are always aligned with the center of the apparatus body 21, the alignment with the outer circumferential reflection surface portion 35 and others can be surely done and the optical disposition becomes constant and the lamp image is certainly reducible.

In these embodiments, it is possible to use not only the so-called T5 type having a tube diameter of approximately 16 mm but also other tubes such as T8 type having a tube diameter of approximately 25.4 mm and T10 type having a tube diameter of approximately 32 mm. In addition, the outer diameter is 170 mm at 15 W, 205 mm at 20 W, 226 mm at 30 W, 300 mm at 32 W and 375 mm at 40 W, and the embodiments are applicable to any combination.

Although in the above-described embodiments the lighting apparatus of the present invention has been described as being of the directly ceiling attached type and the pendant type, the lighting apparatus is not limited thereto but being applicable to arbitrary types.

Furthermore, although the circular fluorescent lamps 51, 52 are coaxially disposed in a substantially plane, it is also possible that they are disposed to partially overlap with each other.

Still furthermore, although the electrical connection and the mechanical connection are concurrently made through the hooking ceiling 12, the electrical connection and the mechanical connection may be individually made, and the connection condition and the configuration are free.

Moreover, although a half-bridge type is used as the inverter circuit 92, it is also possible to arbitrarily use a one-stone type, a parallel inverter type and others.

It is also appropriate that a person sensor for sensing the presence or absence of a person or a brightness sensor for sensing the brightness of the ambience is provided together with or in place of the remote control section 44. In addition, in the case of providing the person sensor, it is possible to light the lamp when a person exists and to put out the lamp when a person is absent, thus surely lighting and certainly putting out as occasion demands. Moreover, by providing the brightness sensor, it is possible to light up the lamp when the ambience is dark and to put out it when the ambience is light, thus surely lighting the lamp and certainly putting out it also as occasion demands, which can achieve the energy saving.

Moreover, if the lamp socket 71 and the inverter are made to be common to the general type fluorescent lamp with an emission tube having a tube diameter of approximately 29 mm, when the lamp socket 71 and the inverter circuit 92 are selectively fitted and any lamp socket 71 and inverter circuit 93 are selected, it is possible to use the general type fluorescent lamp with an emission arc tube having a tube diameter of approximately 29 mm and a fluorescent lamp with an emission arc tube having a tube diameter of 15 mm to 21 mm, so that the parts are usable in common.

In the following, as mentioned hereinbefore, other examples of the circuit diagram for a lighting apparatus of discharge type of the present invention will be described with reference to FIGS. 23 to 33.

Figure 23:
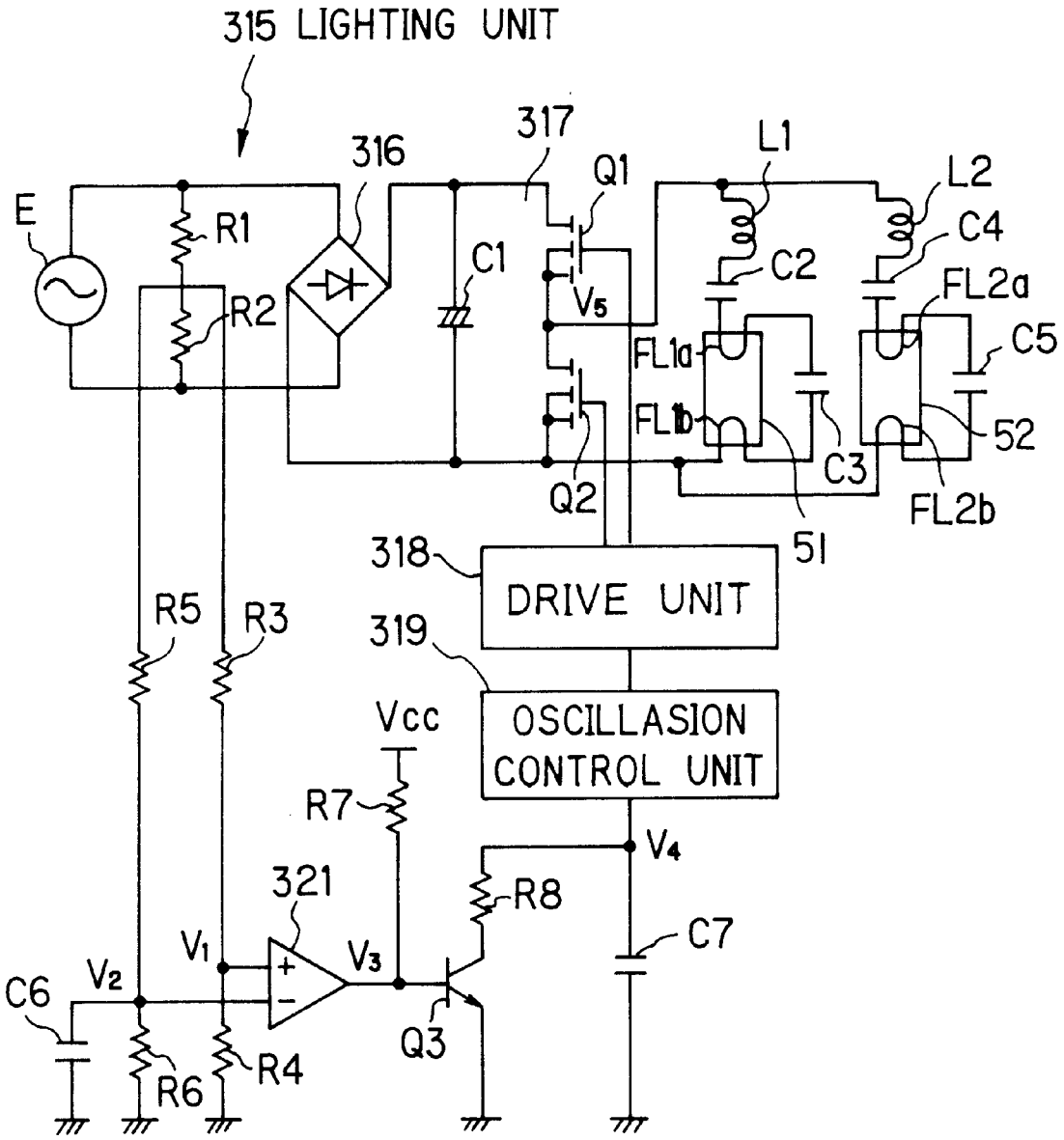
FIG. 23 is a circuit diagram showing a circuit arrangement as another example for that of FIG. 6.

FIG. 23 is an illustration of a circuit of a discharge lamp lighting apparatus such as shown in FIG. 1. It is to be noted that in this example, the circular fluorescent lamp 51 (FIG. 6) is a lamp with a rated lamp voltage of 30 W and the circular fluorescent lamp 52 (FIG. 6) is lamp with a rated lamp voltage of 32 W which serve as discharge lamps. In addition, the fluorescent lamps 51 and 52 are lighted by a discharge lamp lighting circuit 315.

Although the fluorescent lamps 51, 52 have a tube diameter of 15.9 mm which is called T5 type, it is also possible to use a lamp with a tube diameter of approximately 32 mm commonly called T10 type and other lamps, preferably using a lamp called T6 type having a tube diameter less than 19.1 mm.

Figure 24:
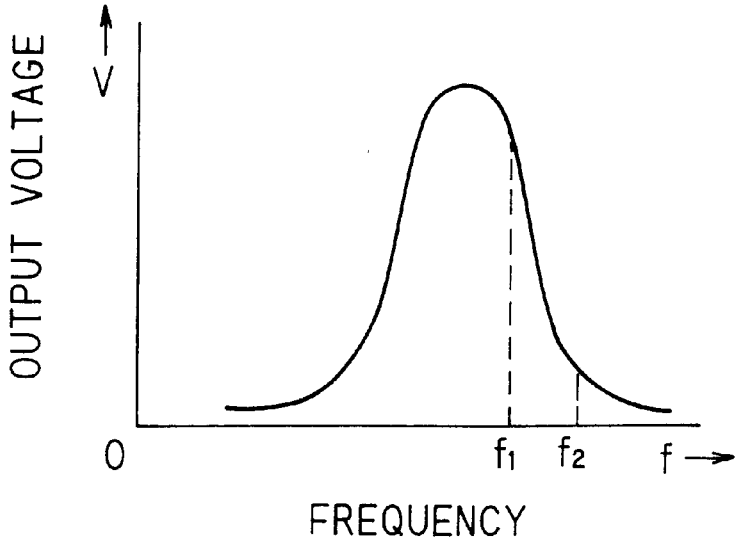
FIG. 24 is a graph showing a relationship between an oscillation frequency and an output power of an inverter circuit of FIG. 23.
Figure 25:
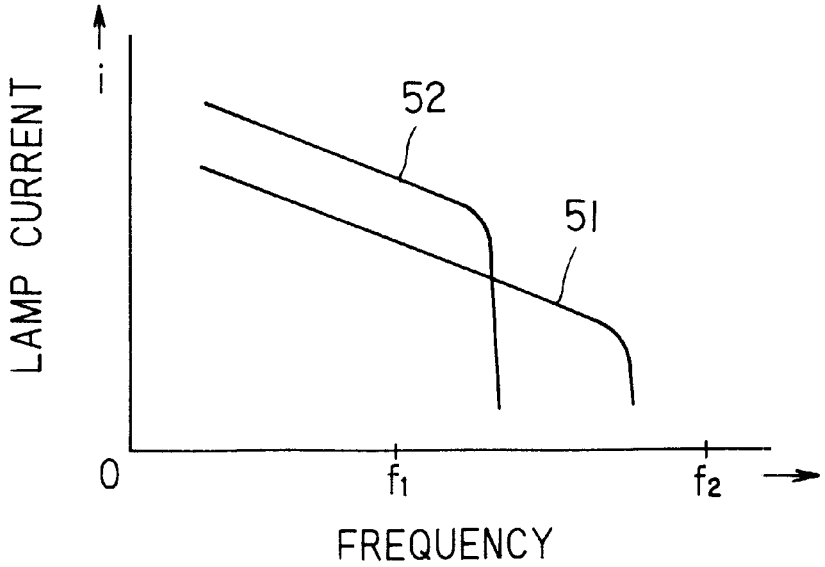
FIG. 25 is a graph showing a relationship between the oscillation frequency and a lamp current.

In the discharge lamp lighting circuit 315 of FIG. 23, an input terminal of a full-wave rectifier circuit such as a diode bridge 316 is connected to a commercial AC power supply source E, a smoothing capacitor C1 is connected to a portion between output terminals of the full-wave rectifier circuit 316. The capacitor C1 supplies a DC voltage. An inverter circuit 317 acting as a half-bridge type inverter means is connected to the capacitor C1. The inverter circuit 317 is composed of a series circuit comprising a field effect transistor Q1 and a field effect transistor Q2, or the like. In addition, a drive unit 318 for driving the field effect transistors Q1 and Q2 is connected to each of the gates of the field effect transistors Q1 and Q2. To the drive unit 318, there is connected an oscillation control unit 319 serving as a control means for a VFO (variable frequency oscillation) or the like which controls the oscillation frequencies of the field effect transistors Q1 and Q2. FIG. 24 is a graph showing the relationship between the output voltage and the oscillation frequency in the inverter circuit 317. The output voltage of the inverter circuit 317 comes to a maximum at the resonance frequency of the inverter circuit 317. The inverter circuit 317 is controlled between the frequencies f1 and f2 slightly higher than the resonance frequency to control its output voltage. Further, it is appropriate to set the frequency to be within a frequency region including the resonance frequency. Further, FIG. 25 is a graph showing the relationship between the frequency and the lamp current. As shown in FIG. 25, the lighting frequency f1 is set to a value so that a current flows to surely light both the fluorescent lamps 51 and 52, while the tuning-off frequency f2 is set to a value to certainly put out the fluorescent lamps 51 and 52. The frequency f1 is set to a value which can start the lighting of both the fluorescent lamps 51 and 52.

Furthermore, between both terminals of the field effect transistor Q2, there are in series connected a ballast choke L1 being an inductive ballast for restricting the lamp current, a DC cutting capacitor C2 and filaments FL1*a*, FL1*b* being electrodes for the fluorescent lamps 51 and 52, and between these filaments FL1*a* and FL1*b*, there is connected a starting capacitor C3 for starting the fluorescent lamp 51 by the resonance with the ballast choke L1 and for preheating the filaments FL1*a*, FL1*b*. Moreover, in parallel to these filaments, between both terminals of the field effect transistor Q2, there are in series connected a ballast choke L2 being an inductive ballast for restricting the lamp current, a DC cut capacitor C4 and filaments FL2*a*, FL2*b* being electrodes of the fluorescent lamp 52, and between these filaments FL2*a*, FL2*b*, there is connected a starting capacitor C3 for starting the fluorescent lamp 52 by the resonance with the ballast choke L2 and for preheating the filaments FL2*a*, FL2*b*.

Still further, a series circuit comprising a resistor R1 and a resistor R2 for voltage detection is coupled to between both terminals of the commercial AC power supply source E, and a series circuit comprising a resistor R3 and a resistor R4 is coupled to a portion between the node between the resistors R1, R2 and the ground, and even one input terminal of an operational amplifier 321 is connected to the node between the resistor R3 and the resistor R4. In addition, in a similar way, a series circuit comprising a resistor R5 and a resistor R6 is connected to between the node between the resistors R1, R2 and the ground, and a capacitor C6 is connected in parallel to the resistor R6. The other input terminal of the operational amplifier 321 is connected to the node between the resistor R5 and the resistor R6. A power supply Vcc is connected through a resistor R7 to the output terminal of the operational amplifier 321, and the base of a transistor Q3 is connected thereto, while the emitter of this transistor Q3 is grounded and the collector thereof is coupled through a resistor R8 to the oscillation control unit 319 which in turn, is grounded through a capacitor C7.

The operation of the inverter circuit 317 will be described hereunder.

The voltage of the commercial AC power supply source E is full-wave-rectified in the full-wave rectifier circuit 316 and smoothed by the capacitor C1 and then supplied to the inverter circuit 317 so that the field effect transistors Q1 and Q2 oscillate. At the lighting of the all lamps, the oscillation control section 319 always lights the fluorescent lamps 52 and 51 at the frequency f1 as shown in FIG. 24. In this state, the fluorescent lamps 52 and 52 are lighted up.

Figure 26:
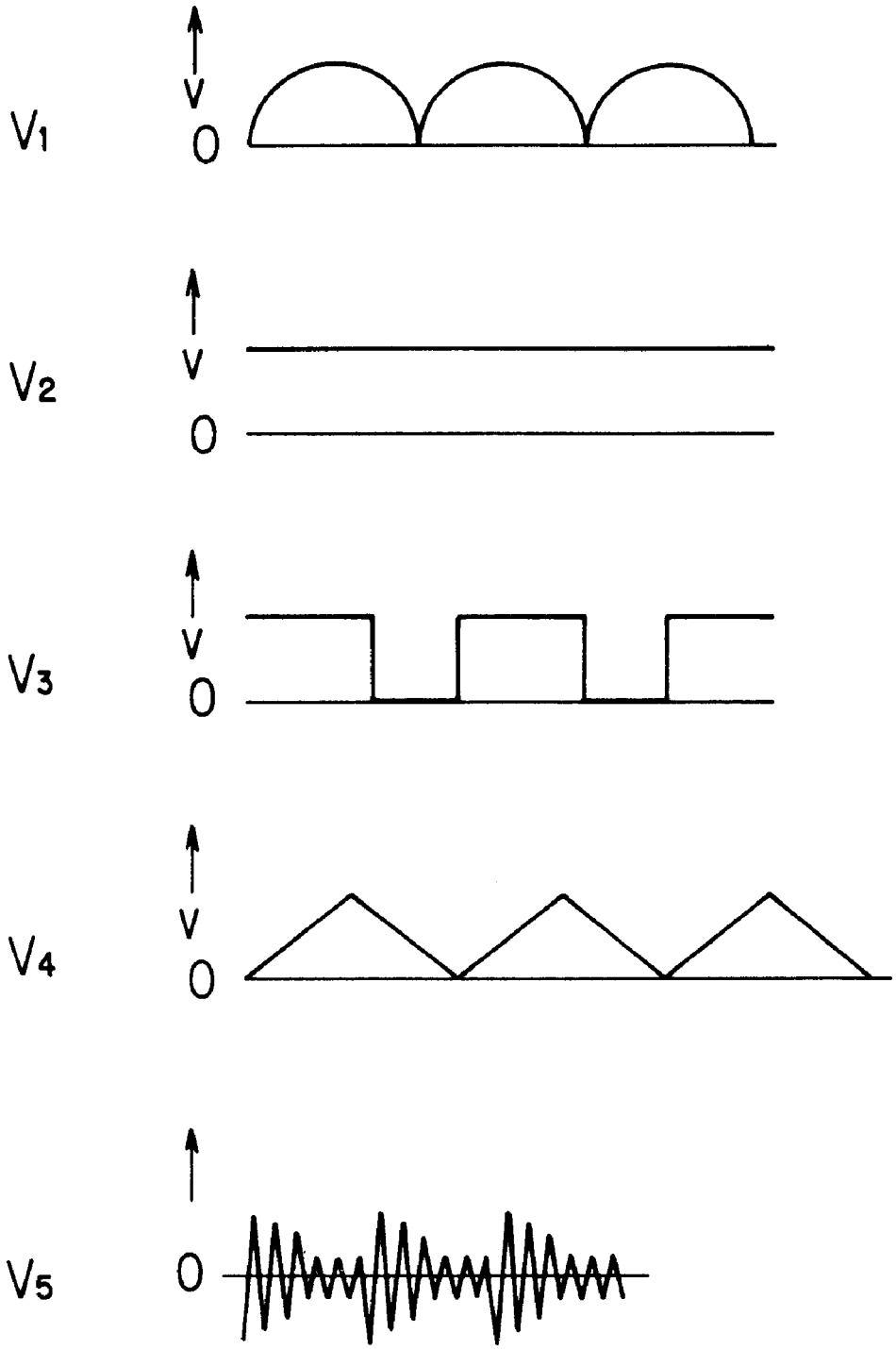
FIG. 26 shows waveforms of the lamp current in the inverter circuit.

In the case of modulated-lighting of the fluorescent lamps, as shown in FIG. 26, the supply voltage of the commercial AC power source E is divided by the resistors R1 and R1 and further divided by the resistors R5 and R6 to charge the capacitor C6, and the voltage of this capacitor C6 is taken as V2. Similarly, the supply voltage of the commercial AC power supply source E is divided by the resistors R1 and R2 and further divided by the resistors R3 and R4, and the voltage across this resistor R4 is taken as V1. The voltage having a frequency of 100 Hz or 120 Hz which is twice the frequency of the commercial AC power supply source E is inputted as a reference, and when this voltage V1 becomes higher than the voltage V2, the operational amplifier 321 outputs a high level to output a voltage V3 with a frequency being twice the frequency of the power supply source E so that the transistor Q3 is on-off-controlled in a state with being synchronized with the supply voltage at a frequency twice that of the commercial AC power supply source E.

Furthermore, owing to the on-off operation of the transistor Q3, the oscillation control section 319 performs a modulation between the frequency f1 and the frequency f2 in synchronism with the voltage of the power supply source E at a frequency being twice that of the power supply source E, and a voltage V4 is inputted to the oscillation control section 319 to vary the output voltage of the inverter circuit 317. Thus, due to the variation of the output voltage of the inverter circuit 317, the lamp current for lighting the fluorescent lamps 51 and 52, the lamp current for putting out these fluorescent lamps are alternately repeated in a state synchronized with the voltage of the power supply source E, thereby modulated-lighting the fluorescent lamps 51 and 52.

Figure 27:
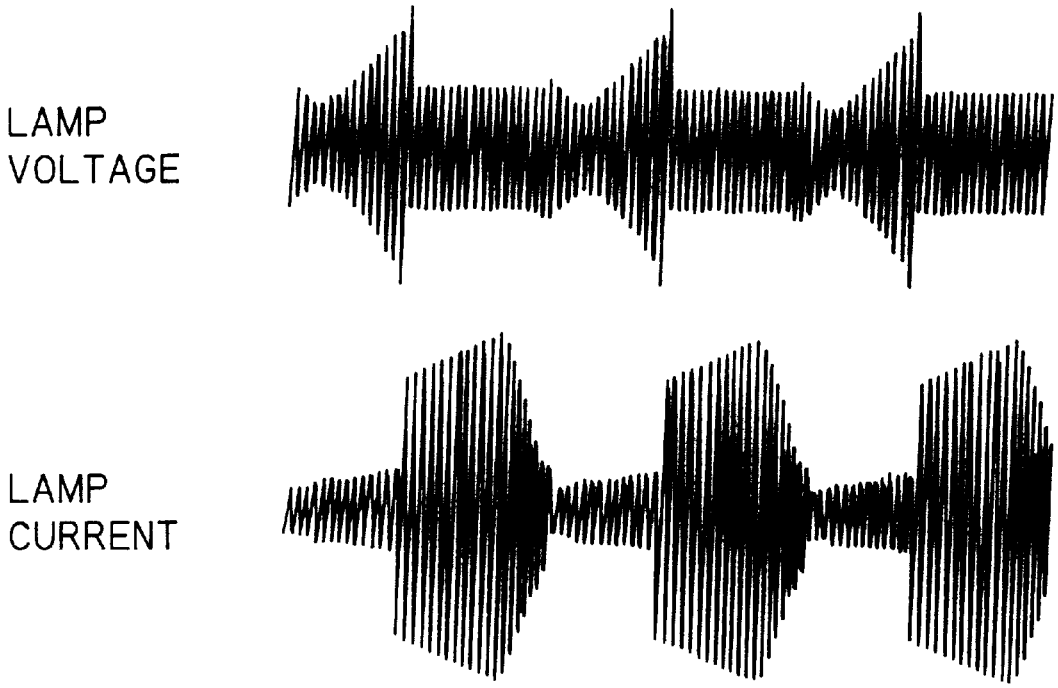
FIGS. 27 and 28 show waveforms thereof.
Figure 28:
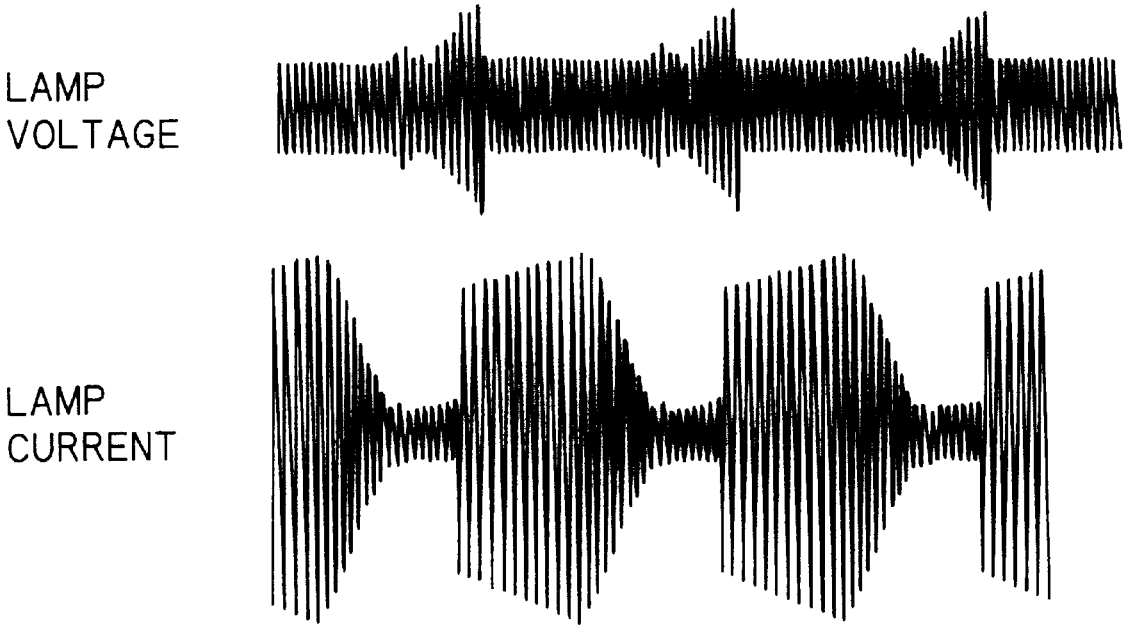

FIGS. 27 and 28 show waveforms of the lamp voltages and the lamp currents. In this case, if the fluorescent lamps 51 and 52 are put out by reducing the lamp current, the secondary voltages of the fluorescent lamps rise. On the other hand, even if the fluorescent lamps 51 and 52 are put out in a manner that the oscillation frequency of the inverter circuit 317 is heightened to lower the voltage and both the fluorescent lamps 51 and 52 are put out, the voltage is applied to all the filaments FL1*a*, FL1*b*, FL2*a*, FL2*b* so as to be in preheated conditions. Thus, it is possible to lower the restarting voltage and to surely relight the fluorescent lamps, and it is possible to suppress the stresses of all the inverter circuit 317 and the fluorescent lamps, and therefore, to lower the cost and lengthen the life. Besides, this is particularly effective to a fluorescent lamp below T6 type which needs a high restarting voltage and has a small tube diameter.

Furthermore, because of a low restarting voltage, it is possible to suppress the noises occurring with flashing at the time of the light modulation.

In this case, even if the fluorescent lamps 51 and 52 are in the put-out conditions, a preheating current flows in all the filaments FL1*a*, FL1*b*, FL2*a*, FL2*b* through the starting capacitors C3, C5. This preheating current causes an excessive state of the filaments FL1*a*, FL1*b*, FL2*a*, FL2*b*, and if the voltage rises between the filaments FL1*a*, FL1*b*, FL2*a*, FL2*b* because of the increase in the resistance values of the respective filaments FL1*a*, FL1*b*, FL2*a*, FL2*b*, the discharge, i.e., the glow discharge, tends to occur between both the terminals of the filaments FL1*a*, FL1*b*, FL2*a*, FL2*b*. In addition, there may cause a problem that the emitters attached to the filaments FL1*a*, FL1*b*, FL2*a*, FL2*b* are splashed toward the tube wall to easily produce the blackening.

In order to eliminate such problem, it is preferable that the oscillation frequency of the inverter circuit 317 is set to a value sufficiently higher than the frequencies by which both the fluorescent lamps 51 and 52 are put out to reduce the filament currents for the filaments FL1*a*, FL1*b*, FL2*a*, FL2*b*. For instance, it is desirable that the oscillation frequency of the inverter circuit 317 is raised to about 100 kHz. Incidentally, from the experiments, the average temperature of the filaments FL1*a*, FL1*b*, FL2*a*, FL2*b* comes down by sufficiently heightening the oscillation frequency of the inverter circuit 317 at the putting-out of the light.

Furthermore, the shifting time from a high frequency for putting out the fluorescent lamps to a low frequency for stably lighting the fluorescent lamps is shortened so as to reduce the filament preheating time in a state that the fluorescent lamps 51, 52 are put out, thereby preventing the excessive rise of the filament temperature and eliminating the end glow.

Figure 29:
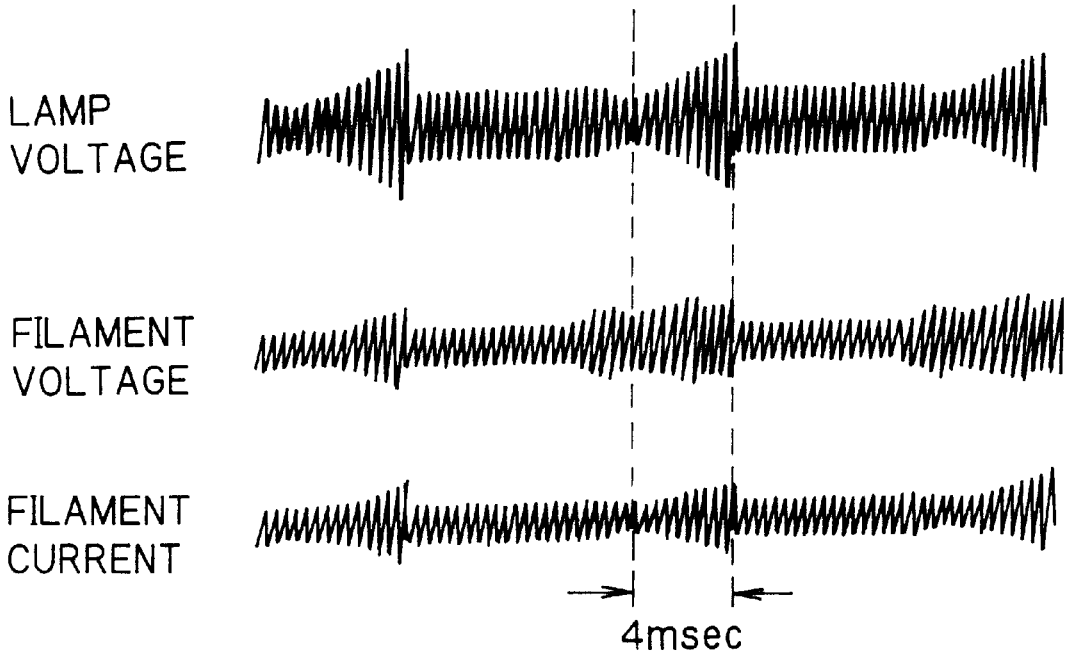
FIGS. 29 and 30 show waveforms representing relationship between a lamp voltage, a filament voltage and a filament current.
Figure 30:
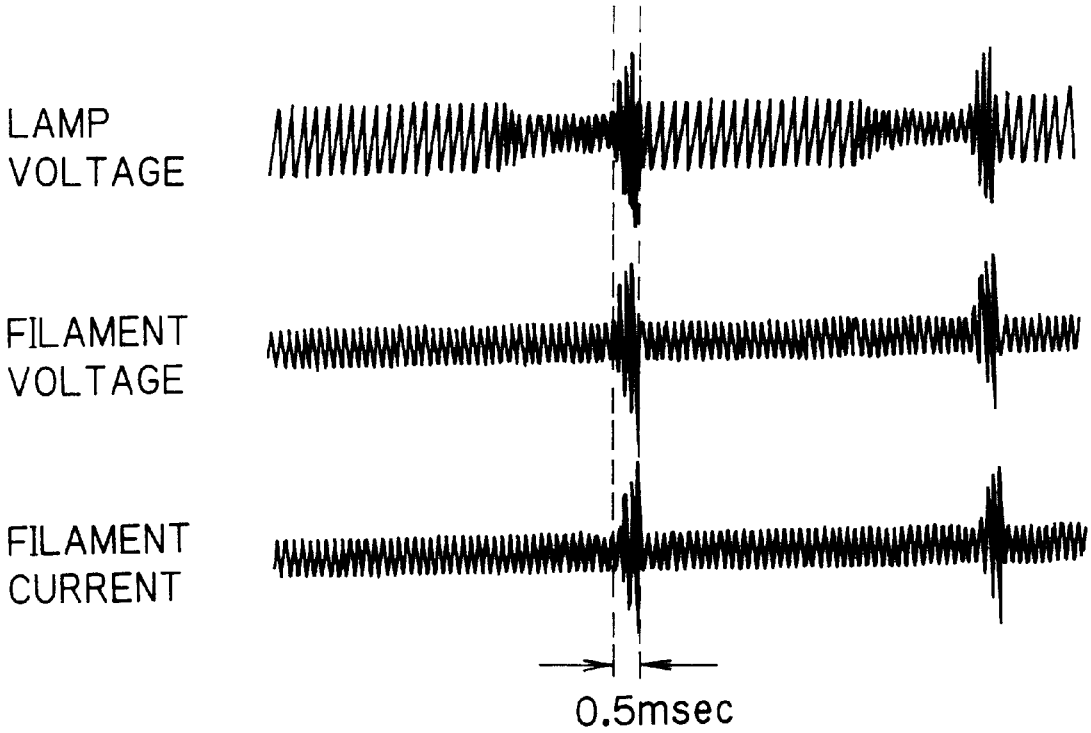

FIG. 29 shows waveforms of a lamp voltage, a filament voltage and a filament current in the case that the time for shifting the oscillation frequency of the inverter circuit 317 from 80 kHz corresponding to the putting-out frequency to 50 kHz corresponding to the stable lighting frequency is set to 4 msec. FIG. 30 shows waveforms of a lamp voltage, a filament voltage and a filament current in the case that the time for shifting the oscillation frequency of the inverter circuit 317 from 80 kHz corresponding to the putting-out frequency to 50 kHz corresponding to the stable lighting frequency is set to 0.5 msec. As shown in these figures, in the case that the shifting time is set to 0.5 msec, it is possible to sharply reduce the time for the increase in the filament current as compared with the case of setting it to 4 msec, and in consequence, it is possible to appropriately maintain the average temperature of the filaments FL1*a*, FL1*b*, FL2*a*, FL2*b* and to prevent the excessive increase in the filament temperature for no occurrence of the end glow.

Figure 31:
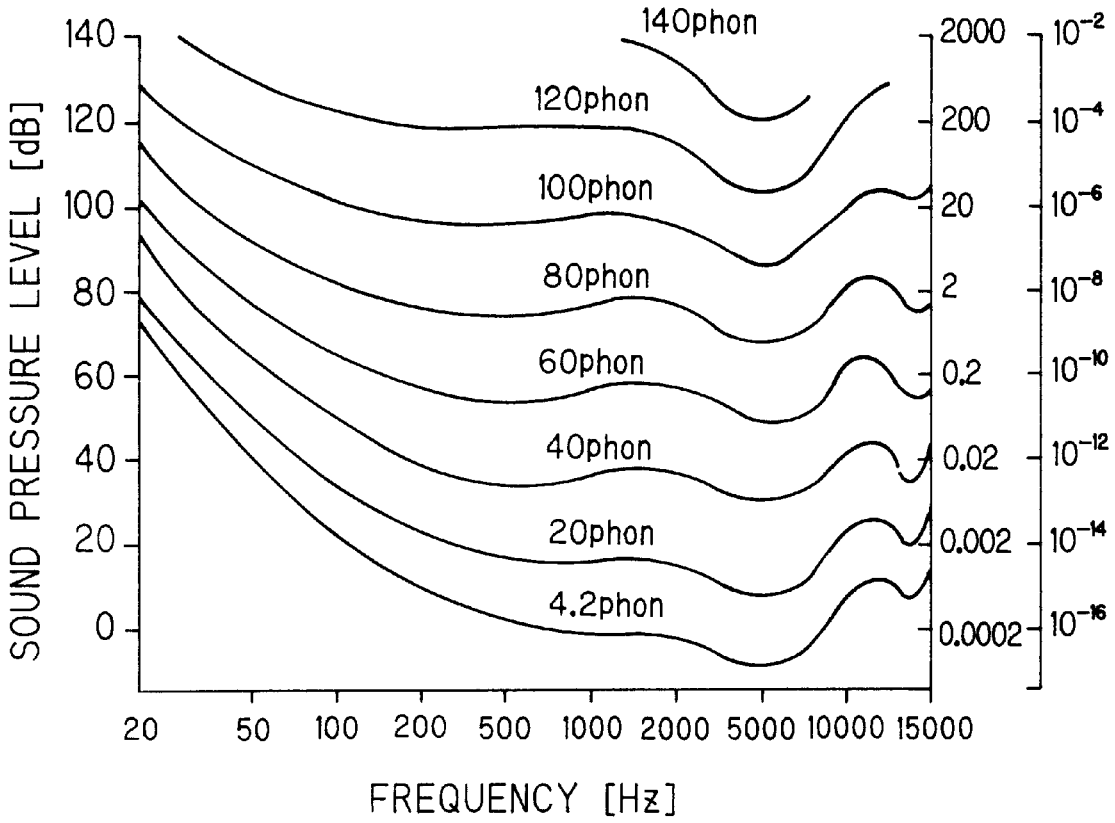
FIG. 31 shows a graph representing a relationship between the oscillation frequency of the inverter circuit and a voice level of a person.

FIG. 31 is a graph showing the easy-to-hear degree to a person in terms of the frequency. As shown in FIG. 31, the frequency for lighting and putting out the fluorescent lamp 51 and 52 is twice that of the commercial AC power supply source E, that is, approximately 100 Hz or 120 Hz, and hence, as compared with 500 Hz easy to hear by the ears of the person, it is sufficiently hard to hear, so that it is possible to suppress even the same sound pressure level to a sufficiently low level.

Figure 32:
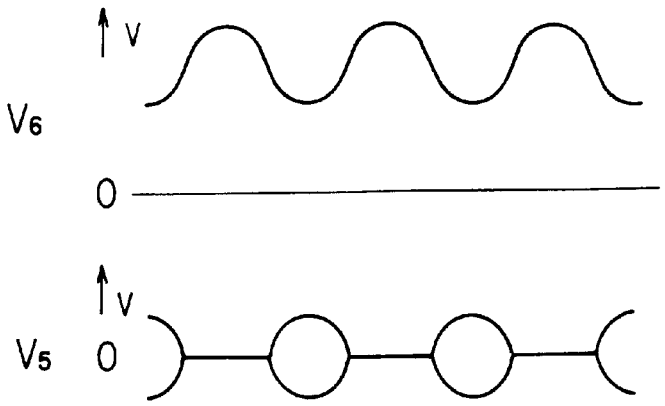
FIG. 32 shows waveforms of an AC voltage and a lamp voltage at a time of light adjustment.

FIG. 32 shows waveforms of a DC voltage and lamp voltage at the light modulation. As shown in FIG. 32, the ripple of the DC voltage is in synchronism with the voltage of the inverter 317, and hence it is possible to easily take the timing between the output of the full-wave rectifier 316 and the inverter circuit 317, and because the lighting and putting-out occur at the same phase angle of the power supply source E, the power supplied to the fluorescent lamps 51 and 52 becomes constant, thus suppressing the flickering of the fluorescent lamps. In addition, the frequency for the lighting and the putting-out assumes approximately 100 Hz or 120 Hz, it is possible to suppress the flickering due to the flashing of the fluorescent lamps.

Still furthermore, because there is no need to perform the control such as feedback to prevent the putting-out unlike the prior art, the circuit arrangement itself can be simplified.

Figure 33:
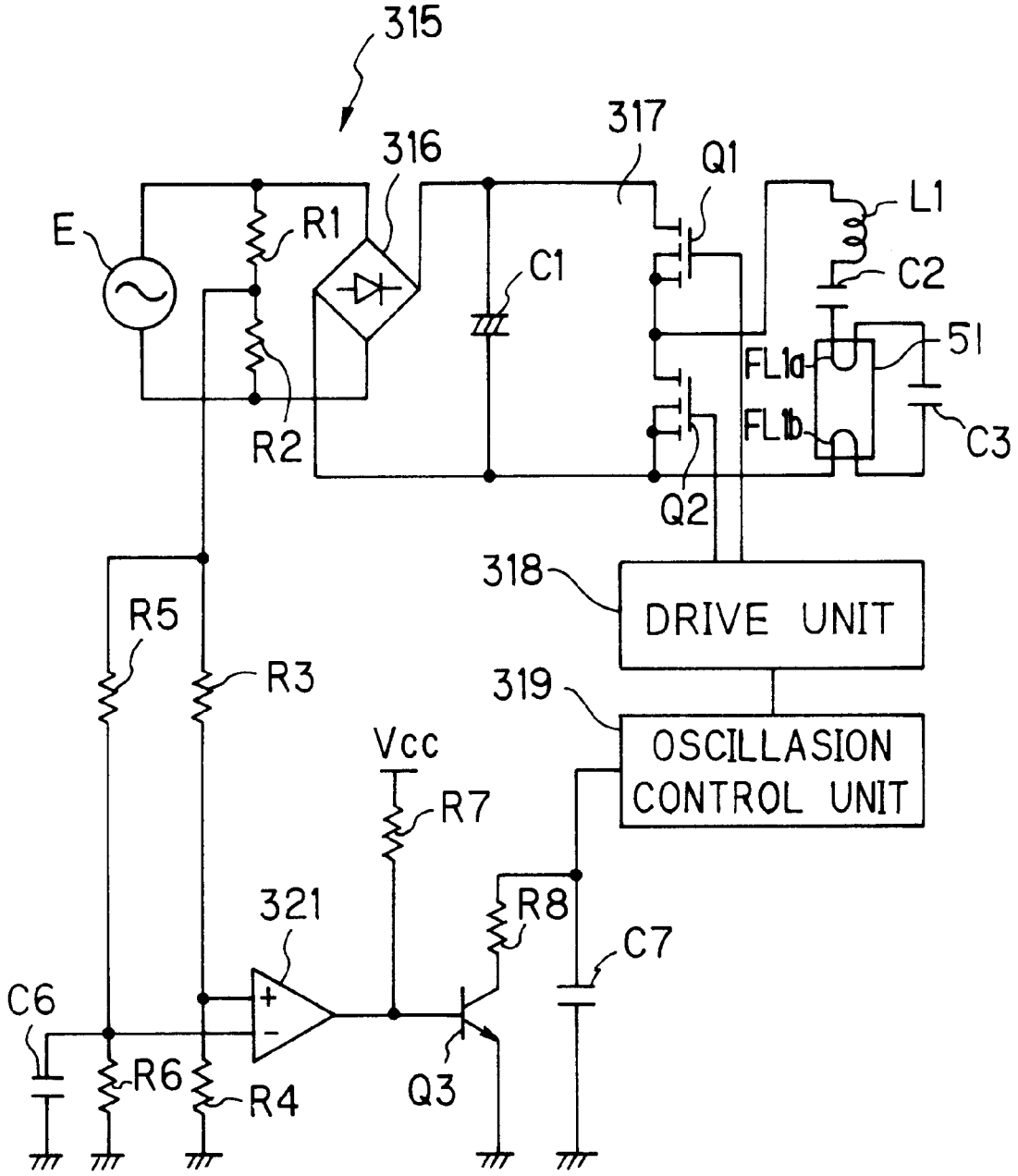
FIG. 33 is also a circuit diagram of a further example of the circuit arrangement for the discharge lighting apparatus.

Moreover, FIG. 33 is a circuit diagram showing a discharge lamp lighting apparatus according to another example, in which like reference numerals are added to elements or components corresponding to those shown in FIG. 23. This discharge lamp lighting apparatus is used for one fluorescent lamp 51 in the discharge lamp lighting apparatus of FIG. 23, and the operation and effects are substantially the same as those of the FIG. 23. It is used for a trough type and others arbitrary equipment.

Incidentally, it is also appropriate that an active filter such as a chopper circuit is connected to the input side of the inverter circuit 317 and is synchronized with the power supply so as to arrange the waveform distortion to improve the power factor and to reduce the higher harmonics.

It is to be noted that the present invention is not limited to the described embodiments and many other changes, modifications and combinations may be made without departing from the scopes of the appended claims.

What is claimed is:

1. A lighting apparatus comprising:

a circular fluorescent lamp unit having inner and outer circular portions arranged coaxially with each other and having outer diameters different from each other, said inner circular portion having an outer diameter of 285 mm to 310 mm and comprising a first arc tube having a tube diameter of 15 mm to 21 mm and said outer circular portion having an outer diameter of 360 mm to 390 mm and comprising a second arc tube having a tube diameter of 15 to 21 mm;

an apparatus body to which said circular fluorescent lamp unit is assembled;

a light reflection member provided for the apparatus body for reflecting a light from the fluorescent lamp unit, said light reflection member including an outer circumferential reflection portion for reflecting a light from the outer circular portion of the fluorescent lamp unit in an outer circumferential direction and an inner central reflection portion for reflecting a light from the inner circular portion of the fluorescent lamp unit in a central downward direction of the apparatus body; and a holder member for holding the fluorescent lamp unit and wherein said apparatus body is formed with a holder member fitting means for detachably mounting the holder member, said holder member fitting means being formed to said outer circumferential reflection portion.

2. A lighting apparatus according to claim 1, wherein said inner central reflection portion has a protruded shape having substantially a triangle shape in elevational section thereof.

3. A lighting apparatus according to claim 1, wherein said apparatus body has a suspension type structure.

4. A lighting apparatus according to claim 1, wherein said first and second arc tubes are independent circular arc tubes disposed coaxially.

5. A lighting apparatus according to claim 1, wherein said first and second arc tubes are composed of a circular arc tube unit having coaxially disposed two circular portions which are electrically connected.

6. A lighting apparatus according to claim 1, wherein said first and second circular arc tubes are arranged substantially in a same horizontal plane concentrically.

7. A lighting apparatus according to claim 1, further comprising a holder member which comprises a lamp socket disposed on one end side thereof for electrically connecting and holding the circular fluorescent lamp unit, a lamp holder portion for holding the circular fluorescent lamp unit disposed on another end side thereof, and an interlocking member for holding the lamp socket and the lamp holder portion at an equal distance from a central position thereof.

8. A lighting apparatus according to claim 7, wherein said lamp socket has a structure applicable to a general type fluorescent lamp including an arc tube having a tube diameter of approximately 29 mm.

9. A lighting apparatus according to claim 1, further comprising a holder member which includes a lamp holder portion for holding the circular fluorescent lamp unit and said lamp holder portion is formed with a cord pressing member for preventing a cord, through which an electricity is supplied to the circular fluorescent lamp unit, from projecting from the apparatus body.

10. A lighting apparatus according to claim 1, further comprising a shade attached to said apparatus body.

11. A lighting apparatus according to claim 1, wherein said apparatus body is provided with a substrate member to which is mounted a lighting control circuit means which is controlled by a remote control means provided for the apparatus body.

* * * * *